US007104329B2

(12) United States Patent
Kleinhans

(10) Patent No.: US 7,104,329 B2
(45) Date of Patent: Sep. 12, 2006

(54) MARINE BOTTOMED TENSIONED RISER AND METHOD

(75) Inventor: John W. Kleinhans, Houston, TX (US)

(73) Assignee: BP Corporation North America Inc., Warrenville, IL (US)

( * ) Notice: Subject to any disclaimer, the term of this patent is extended or adjusted under 35 U.S.C. 154(b) by 88 days.

(21) Appl. No.: 10/423,249

(22) Filed: Apr. 25, 2003

(65) Prior Publication Data

US 2004/0031614 A1 Feb. 19, 2004

Related U.S. Application Data

(60) Provisional application No. 60/375,619, filed on Apr. 26, 2002.

(51) Int. Cl.
*E21B 29/12* (2006.01)

(52) U.S. Cl. ..... 166/355; 166/354; 166/367; 405/224.2

(58) Field of Classification Search ..... 166/355, 166/354, 352, 367, 350; 405/224.2, 224.4
See application file for complete search history.

(56) References Cited

U.S. PATENT DOCUMENTS

| | | | | |
|---|---|---|---|---|
| 3,189,098 | A * | 6/1965 | Haeber | 166/352 |
| 3,461,916 | A * | 8/1969 | Ledgerwood, Jr. | 138/120 |
| 3,701,551 | A * | 10/1972 | Morgan | 285/124.1 |
| 3,718,183 | A * | 2/1973 | Scott | 166/359 |
| 3,913,668 | A * | 10/1975 | Todd et al. | 166/359 |
| 4,049,239 | A * | 9/1977 | Howell | 166/355 |
| 4,067,202 | A * | 1/1978 | Reed | 405/224.2 |
| 4,137,948 | A * | 2/1979 | Van Heijst | 138/120 |
| 4,279,544 | A * | 7/1981 | Brun et al. | 405/202 |
| 4,362,215 | A * | 12/1982 | Sparks | 166/367 |
| 4,456,073 | A * | 6/1984 | Barth et al. | 166/367 |
| 4,529,334 | A * | 7/1985 | Ortloff | 405/224.2 |
| 4,557,332 | A * | 12/1985 | Denison et al. | 166/345 |
| 4,615,542 | A * | 10/1986 | Ideno et al. | 285/11 |
| 5,553,976 | A * | 9/1996 | Korsgaard | 405/195.1 |
| 5,846,028 | A * | 12/1998 | Thory | 405/195.1 |
| 2005/0006101 | A1 | 1/2005 | Sele | 166/367 |

OTHER PUBLICATIONS

"Rigid Risers For Floating Production Systems In Deepwater Field Developments" by Brian M. McShane, et al.; *Pipes and Pipelines International*, vol. 45, No. 1, Jan.-Feb. 2000, Cover Page, pp. 1 and 21 through 34.

"A Proposal For A Deep Water Riser System" by Leiv Wanvik, Sep. 200?, Ten (10) colored pages.

* cited by examiner

*Primary Examiner*—Thomas A Beach
(74) *Attorney, Agent, or Firm*—James A. Gabala

(57) ABSTRACT

A new marine oil production riser system for use in deep-water applications is disclosed. An efficient means for accommodating movements of the host facility, while maintaining riser top tension within the limits for long-term riser performance. Long riser stroke lengths can be accommodated without requiring complex interfacing with the top-sides. The riser assembly comprises: a generally extendable substantially non-vertical section having an upper end adapted to be in flow communication with a generally vertical marine riser carried by a facility floating on the surface of a body of water, and having a lower end adapted to be in flow communication with a fluid source on the seafloor; and tensioning means, mechanically connecting the upper end of the marine riser with the lower end of the marine riser, for biasing said ends towards each other. The tensioning means comprises: a cylinder having one end open to sea pressure, having an opposite end sealed from sea pressure, and connected to one end of the marine riser; a piston within the cylinder disposed for movement within the cylinder; and a piston rod passing through the opposite end of the cylinder and having one end connected to the other end of the marine riser.

22 Claims, 10 Drawing Sheets

Plan View

For a given pipe Do, let r = 5Do:

$\beta = \tan^{-1}(r/r) = 45^{\circ}$; (1)

$Rc = r/\cos\beta + r = r\,(1/\cos\beta + 1)$; (2)

and since r = 5Do:

$Rc = 5Do(1/\cos\beta + 1)$ (3)

MARINE BOTTOMED TENSIONED RISER AND METHOD

CROSS-REFERENCE TO RELATED APPLICATIONS

This application claims the benefit under 35 USC §119(e) of a United States (US) provisional patent application filed on Apr. 26, 2002 under Ser. No. 60/375,619 whose contents are incorporated by reference.

TECHNICAL FIELD

This invention relates to the general subject of production of oil and gas and, in particular, to marine risers used in the production of oil and gas from the seabed.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

Marine riser technology and its development have been driven by two basic needs in the oil industry.

The first need has been to resolve the challenges that are related to using drilling risers during exploratory drilling. These risers bridge between the seabed and the surface when doing exploration drilling from a floating vessel, which is normally either a semi-submersible drilling rig, or a drill ship. These riser needs can be characterized as large diameter and relatively low pressure. They are designed for rapid disconnect from the seabed equipment, efficient running and retrieval via the drilling vessel, and relatively short design life. Basic floating drilling methods were established in the 1960's[1] (superscripts refer to "List of References" appearing before the Claims at the end of this specification) and these methods continue to be improved upon today[2].

The second riser need occurs when exploration drilling is successful, leading to a field development. These field development risers bridge between the life-of-field development seabed and surface Host Facility. These risers have small diameters and large diameters, operate at relatively high pressures, and are designed in accordance with field development expectations for near-continuous hydrocarbon depletion that may require 20 years and more of uninterrupted service. These risers may include export and import riser systems that are related to the hydrocarbon production and sales. Also, if well drilling and completion is to be performed from the Host Facility, these riser needs have also to be addressed[3].

The pace for deepwater developments in the Gulf of Mexico has been dramatic since the mid-1990's. A brief summary is presented in Appendix IV. The Industry has gone through a series of stages of riser technology development, resulting in the present preferred Steel Catenary Riser (SCR)/Flowline (FL) riser solutions for deepwater. SCR's have evolved in a natural way to replace the large, complex and costly top tensioning equipment that are required when vertical riser systems are used. Vertical risers with top tensioning are effective to water depths of about 4000 feet. However, top tensioning equipment, because of its size, weight, and tight clearances, is costly and difficult to manage. This geometric relationship becomes increasingly challenging when the Host Facility must support this equipment for riser strokes of more than 7–12 feet. For one project in the Gulf of Mexico in 6000 feet of water, riser top motions can approach about 20 feet. These motions represent major design challenge, even for the SCR/FL risers. The challenge is magnified due to the large number of risers that must bridge between the seabed and the Host Facility.

This stroke length is necessary to accommodate the change in riser system length as the Host Facility moves from its neutral position. Without this riser stroke, the riser would be subjected to either over-stressing or large stress level cycles. Riser failure can be manifested by either overstressing it, or by subjecting it to excessive stress cycling. The stress cycling can lead to riser failure due to accumulated fatigue damage, even though the allowable stress is not exceeded for the riser system.

The riser stroke length challenge is graphically represented in FIG. E-2 of a U.S. provisional patent application filed on Apr. 26, 2002 under Ser. No. 60/375,619. When a riser is attached to a fixed point on the seabed and directly to the Host Facility, the riser top must move along with the Host Facility. Considering the life of field possibilities, the range of motions that may occur is extensive. The solution to this changing riser length (stroke requirement) should be robust, as failure to do so is can lead to riser failure. Riser failure can be caused either by the immediate effect of over-stressing, or by diminished fatigue life due to excessive stress cycling. Riser failure due to collapse can also occur, but this tends to be a direct consequence of over-stressing it. In the case of Host Facilities that have very large motions, such as the FPSO systems that have been used outside the Gulf of Mexico, the riser stroke requirement can be met by using flexible pipe[16].

A flexible pipe solution (See FIG. E-3(a) of the U.S. provisional patent application filed on Apr. 26, 2002 under Ser. No. 60/375,619), has been used successfully many times. However, for very deep water, this method can be costly. Also, flexible pipe technology for risers (i.e., ones that require a design combination of deepwater, high pressure, high temperature, or large size) remains under ongoing development before flexible pipe will be ready for the long field life riser applications. Flexible pipe risers can provide good closing solutions when used in conjunction with a free-standing rigid riser (See FIG. E-3(b) of the U.S. provisional patent application filed on Apr. 26, 2002 under Ser. No. 60/375,619). This arrangement is sometimes referred to as a "hybrid riser" because it combines elements of both buoyancy for top tensioning of the steel risers and flexible pipe to complete the bridging from the top of the rigid risers to the Host Facility. This arrangement is commonly used for Spar well system jumpers that bridge between the well tree and the host manifold. The flexible pipe elements are comprised of a wall body that is made up of various combinations of metal and elastomers. The flexible pipe design is tailored to meet each specific application need. Although the resulting flexibility can help resolve the strokelength challenges that exist with rigid risers and they provide an efficient closing duty, their use for a life-of-field application for the entire riser system remains uncertain. Also, specialized installation methods are often used to ensure that the integrity of flexible pipe is maintained.

The fundamental need for a top-tensioning assembly is represented in FIG. E-4A of the U.S. provisional patent application filed on Apr. 26, 2002 under Ser. No. 60/375,619). In that example, no top-tensioning assembly with stroke length change is provided for the riser. Thus, it bridges directly between the seabed connection point and a point on the host facility. This is only shown as a hypothetical configuration. It assumes that the Host Facility could be designed such a way that the combination of hull and mooring would limit the hull motions so that this would be feasible. Also, it assumes that no over pull is applied to the riser at the neutral position. In an actual design, some over pull is necessary to ensure riser integrity for the range of environmental loads to which it will be subjected. However, as can be seen in this drawing, as the Host Facility moves laterally from its neutral position, the riser top-tensile stress begins to increase rapidly. In this example, an allowable material stress value of about 60,000 psi was assumed. Modern steels can be manufactured to provide material properties like this, including the direct requirement for suitable welding methods. Work to provide suitable commercial grade steels of higher stress values is continuing. But if it were possible to keep the Host Facility offset to within a very small percent of water depth, this type of rigid riser could be feasible today if cost realities related to the hull and mooring were not a consideration.

Given the recent pace of these developments, it is easy to understand why a deepwater field development would be based on the most proven riser systems that are available to the system designers. However, when subsea wells and equipment are located directly under the Host Facility, managing the seabed equipment, wells flowlines, and risers is costly and complex. The SCR/Flowline system requires that the SCR be routed in a straight line and away from the Host Facility. The flowline is routed around and back under the Host Facility, where it can then be connected to the subsea manifold using a jumper. Also, a flowline jumper arrangement is required to allow efficient transition between the SCR and the flowline. The drilling riser that is located on the Host Facility can be equipped with a conventional riser top-tensioning system. This is possible because it can be disconnected when Host Facility motions exceed a predetermined limit. Since the production export and import risers cannot be disconnected this way, the use of a top tensioning assembly at the surface for these risers can only be obtained at the expense of space, weight, and clearance requirements on the topsides. The complexity and cost of doing this is high for deepwater applications. This is the fundamental reason why the SCR/Flowline method has been used. It represents a better solution than can be achieved by using a vertical riser with a top tensioning assembly. Top-tensioned risers continue to meet field development needs, and it is expected that they will continue to do so for many situations. Even so, the need for new approaches continues. Current riser design practices[15] recognize this need, and theses practices provide guidance on the approaches that can be used to qualify new riser designs.

In those cases that require vertical access into the riser system, a top tensioning assembly may continue to be a preferred solution, as this may be the only practical means for providing vertical riser access for well drilling and completion purposes. However, some types of risers do not require vertical access. These riser systems include the export and import risers that are used to move products away from and onto the Host Facility. The SCR/FL solution can also be used to meet these duties, especially for the larger riser sizes.

These problems have existed for some time. Considerable effort has been made, and significant amounts of money have been expended to resolve this problem. In spite of this, the problem still exists. Actually, the problem has become aggravated with the passage of time because the water depth requirements continue to rely on costly solutions, or solutions that are approaching their limits of practical application.

SUMMARY OF THE INVENTION

In accordance with the present invention, a bottom tensioned riser (BTR) assembly is disclosed comprising: a generally extendable coil section having an upper end adapted to be in flow communication with a generally vertical marine riser carried by a facility floating on the surface of a body of water, and having a lower end adapted to be in flow communication with a fluid source on the seafloor; and tensioning means, mechanically connecting the upper end of the marine riser with the lower end of the marine riser, for biasing said ends towards each other. The tensioning means comprises: a cylinder having one end open to sea pressure, having an opposite end sealed from sea pressure, and connected to the lower end of the vertical marine riser; a piston within the cylinder slidably and sealingly disposed for movement within the cylinder; and a piston rod sealingly and slidably moving through the opposite end of the cylinder having one end connected to the piston and having an opposite end connected to the upper end of the vertical marine riser.

The BTR can be designed to meet a wide range of Host Facility motions throughout the field development life, and it eliminates the need for disconnecting the vertical export/import riser. This is made possible by virtue of a coil section, which is located in the lower portion of the riser system. One unique aspect of the invention is that it solves a riser system application problem that has normally been approached from the surface/Host Facility (i.e., from the top down). The BTR concept, which approaches the top tension problem from the bottom up, provides a solution that has both technical and cost benefits.

The technical benefits include its use as a vertical riser system. The vertical riser system projection onto the seabed is low when compared to other methods. By virtue of this, it simplifies the seabed architecture. Simplicity in deepwater operations is directly related to the magnitude of risk of unplanned occurrences happening. The vertical riser design can be performed using analysis techniques and assumptions that are proven. The time required to do the analysis of a vertical riser is roughly one-half that of a SCR. The reason that the SCR requires so much more time is that it is a relatively new type of riser itself. Specialized and proprietary analysis methods are required for demonstrating riser fatigue life at the SCR touchdown point. The SCR touchdown point and lift-off modeling remains an area that is under research work to better resolve uncertainties about the models and their required assumptions. A SCR also requires proprietary modeling that is related to vortex-induced-vibrations (VIV). Since the riser shape is not vertical through the water column, VIV modeling cannot be performed in the traditional ways. Research work in this area of modeling is also continuing. The BTR concept can be designed to impose a relatively low top tensile load on the Host Facility. This tensile load change can be designed to be relatively small as the Host Facility goes through its full range of motions. This feature reduces the risks that are associated with predicting both the riser system maximum tensile stress and the fatigue design life that results from stress cycles. The BTR design can be configured to be forgiving without incurring excessive costs. If Host Facility motions are not identical to analytical predictions or model basin simulations, the BTR can be configured to provide a conservative design margin to allow for the differences from these predictions.

The BTR coil section can be designed so that it contains a minimum number of active components that require maintenance or repair. If it is necessary to replace any of these elements during field life, the coil section design lends itself to either replacement of individual components or the entire coil section, if this is necessary.

Cost efficiency of the BTR over present methods is summarized in FIG. D-3 of the U.S. provisional patent application filed on Apr. 26, 2002 under Serial No. 60/375,619. Riser sizes depend on specific application needs, but 8-inch through 12-inch sizes are common. Both smaller and larger sizes may be necessary in any particular application, but the trends that are identified in this Figure are representative. In comparison to the SCR/Flowline method, the BTR cost benefit is estimated to be about $2.9 million; $3.2 million; $3.5 million for each 8-inch, 10-inch, and 12-inch riser, respectively. This comparison assumes that a completely independent riser installation is used to install the BTR systems. When the Host Facility is equipped with a drilling rig, it is feasible to consider using the drilling rig to do the BTR running activities. If this BTR alternative is used, these same benefits are estimated to increase to $3.9 million, $4.3 million, and $4.8 million. Overall, the first set of benefits represent about a 33 percent cost reduction.

Most deepwater field developments will require site-specific numbers and sizes of risers. A representative example is provided in FIG. D-4 of the U.S. provisional patent application filed on Apr. 26, 2002 under Ser. No. 60/375,619). In this example, the BTR benefit represents a cost reduction of about $54 million, and the alternative BTR installation method represents about $75 million. These are cost benefits of about 32 percent and 44 percent, respectively.

Since the coil section diameter is relatively large, it is located a substantial vertical distance away from the Host Facility. By placing the coil section near the bottom of the riser, the required space is readily available. This location has the inherent and important advantage that it then only needs to support its own self-weight during installation and operation. If it were to be placed near the top of the riser, it would not only have to carry its own weight, but that of the riser suspended below it, both during installation and throughout its operating life.

In the case of export and import risers, the BTR invention may provide cost benefit over alternative riser solutions. And when compared to present methods, the technical benefits may also be significant, especially for deepwater configurations that use seabed equipment that is located under the Host Facility.

The BTR system is one way to simplify the deepwater challenge. Riser top tensile stresses for this new system are shown in FIG. E-4B of the U.S. provisional patent application filed on Apr. 26, 2002 under Ser. No. 60/375,619). That figure shows that the new rigid riser system can provide a relatively low top tensile stress level across the range of possible Host Facility motions.

Numerous other advantages and features of the present invention will become readily apparent from the following detailed description of the invention, the embodiments described therein, from the claims, and from the accompanying drawings.

LIST OF TABLES

Table 1 BTR Advantages and Disadvantages

DETAILED DESCRIPTION

Figure 1:
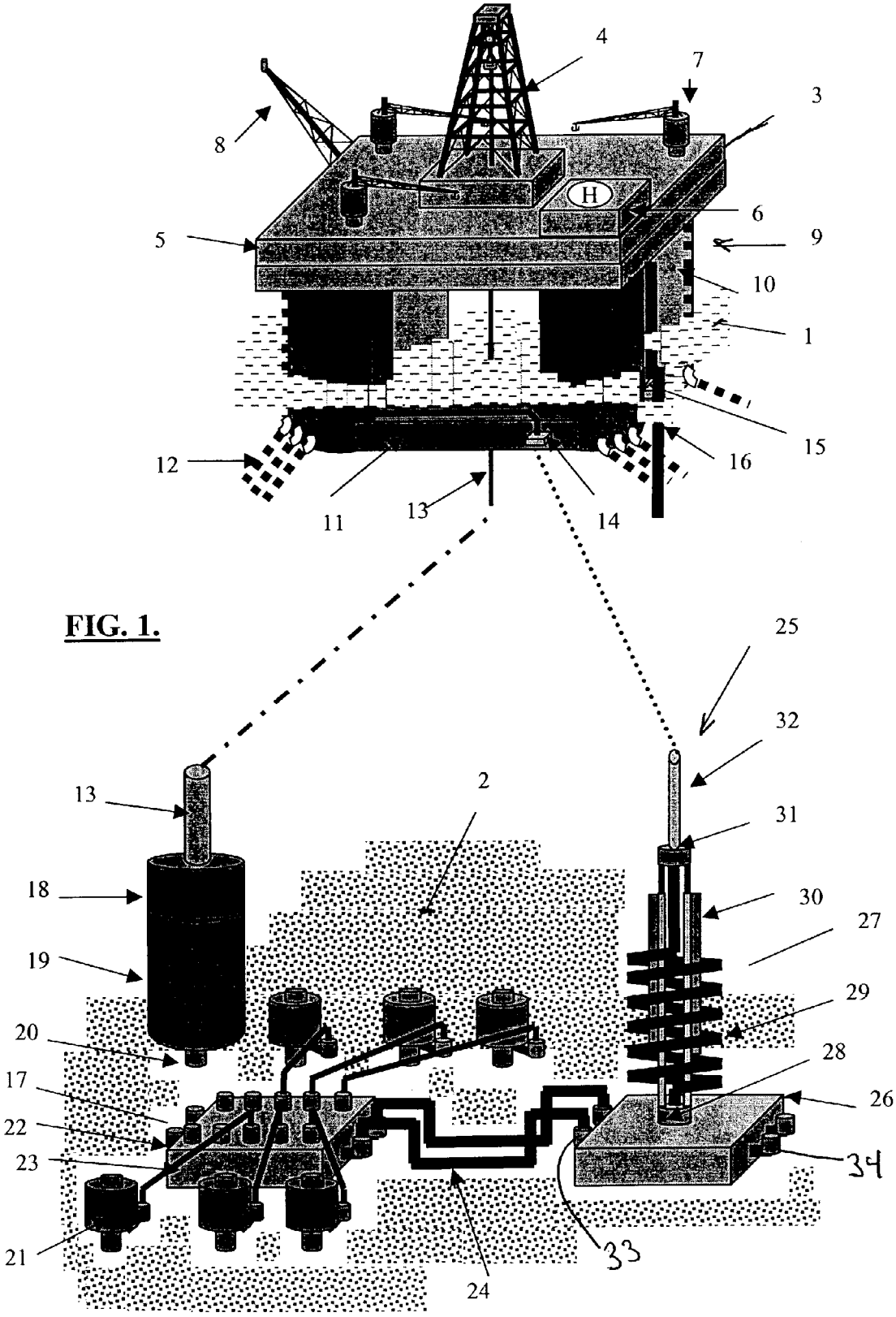
FIG. 1 shows the overall environment of the invention.

While this invention is susceptible of embodiment in many different forms, there is shown in the drawings, and will herein be described in detail, one specific embodiment of the invention. It should be understood, however, that the present disclosure is to be considered an exemplification of the principles of the invention and is not intended to limit the invention to any specific embodiment so described.

Turning to FIG. 1, the invention, and the overall environment of one embodiment of the invention is illustrated. At the upper half of the drawing is shown a Host Facility in the form of a semi-submersible platform and a floating production system 3 Production Drilling Quarters (PDQ). The PDQ comprises a drilling rig 4, topsides 5, crew quarters 6, cranes 7, and an emergency flare 8. The superstructure of the PDQ is supported by columns 10 which are connected to pontoons 11 which are submerged below the surface 1 of the water. The PDQ is positioned by mooring lines 12 which extend to the seabed 2. A drilling riser 13 is shown supported by the drilling rig 4. Also shown are a production riser porch 14 and an export pipeline porch 15. An export pipeline 16 sends oil to another facility.

Looking at the bottom of FIG. 1, a clustered well manifold system 17 is shown on the seafloor 2. The drilling riser 13 extends to a lower marine riser package 18 and a blowout preventer 19 to a subsea wellhead 20. Flowline jumpers 23 join subsea Christmas Trees 21 to a subsea manifold 22. Manifold jumpers 24 join the subsea manifold 22 to the Bottom Tension Riser (BTR) system 25 that is the subject of the present invention.

Figure 2:
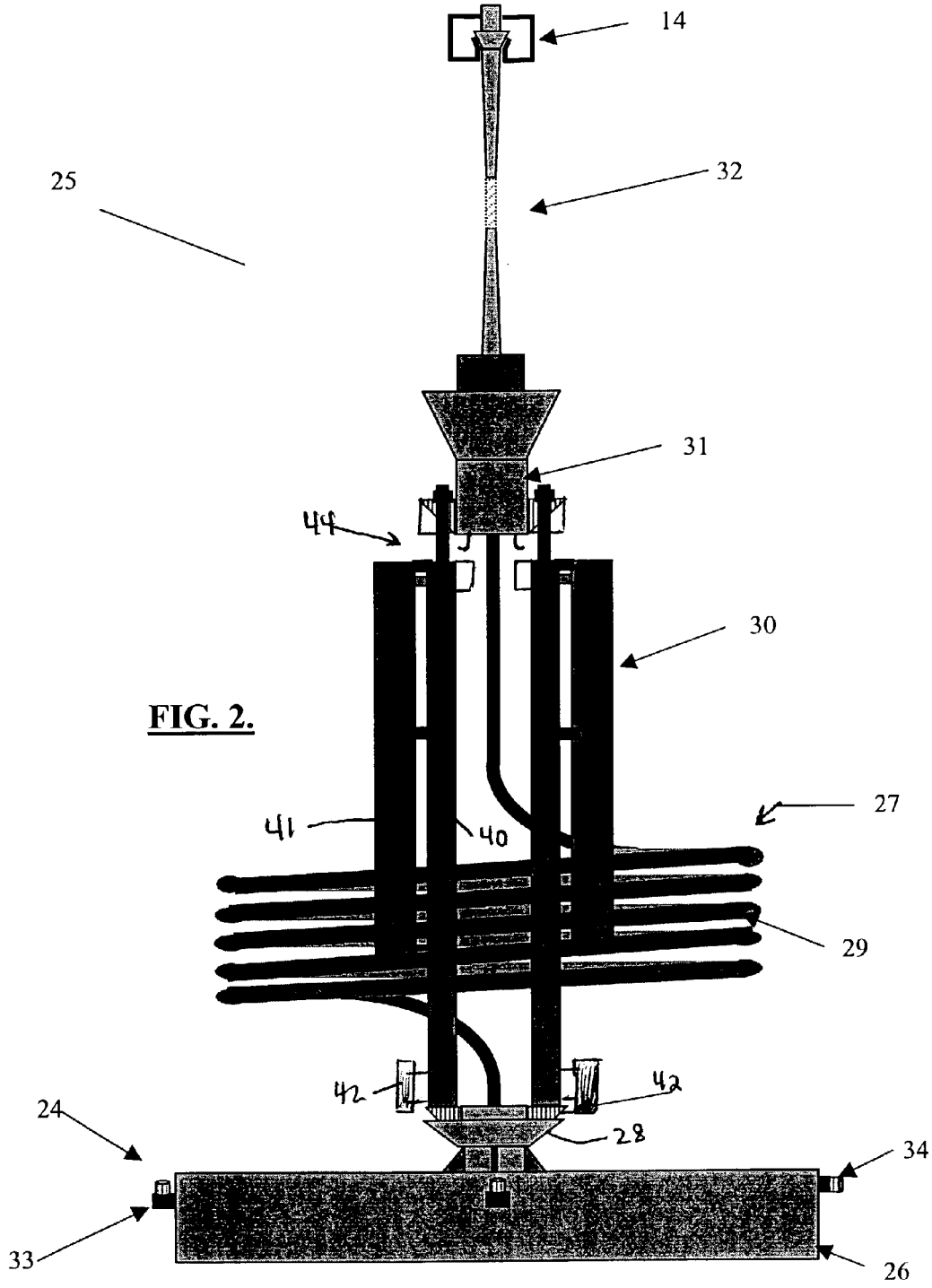
FIG. 2 illustrates a side elevation view of a basic embodiment of the invention.
Figure 3:
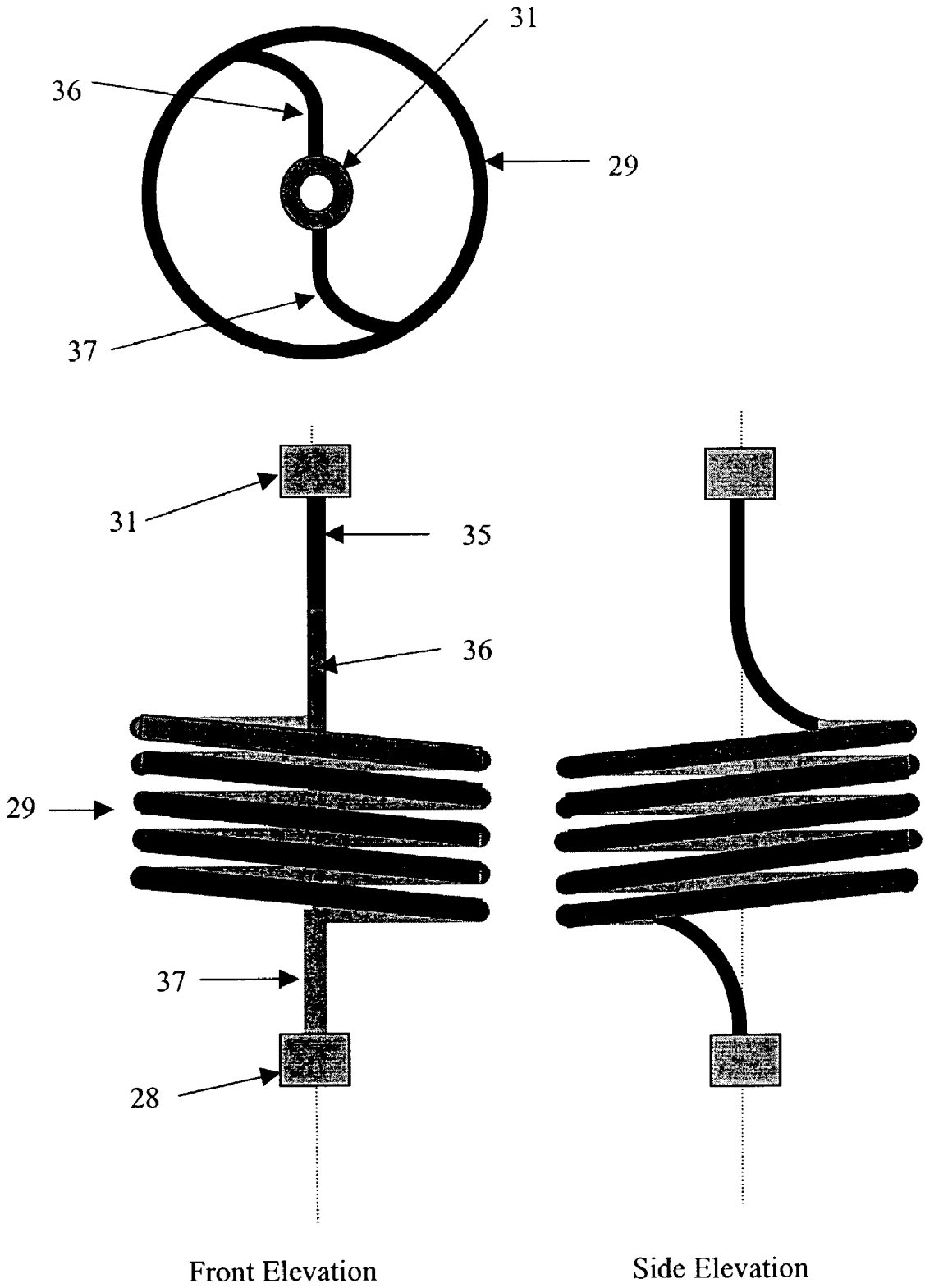
FIG. 3 depicts top, side elevation, and front views of the Coil Section.

Turning to FIG. 2 and FIG. 3, the BTR system 25 is located above the riser base 26 and below a generally long vertical section of main production riser 32. The BTR comprises a Coil Section 27, a lower connector 28, flexing elements 29, a tensioning assembly 30, and an upper connector 31. The riser base 26 has a jumper vertical connector hub 33 and a horizontal connector hub 34

Figure 4:
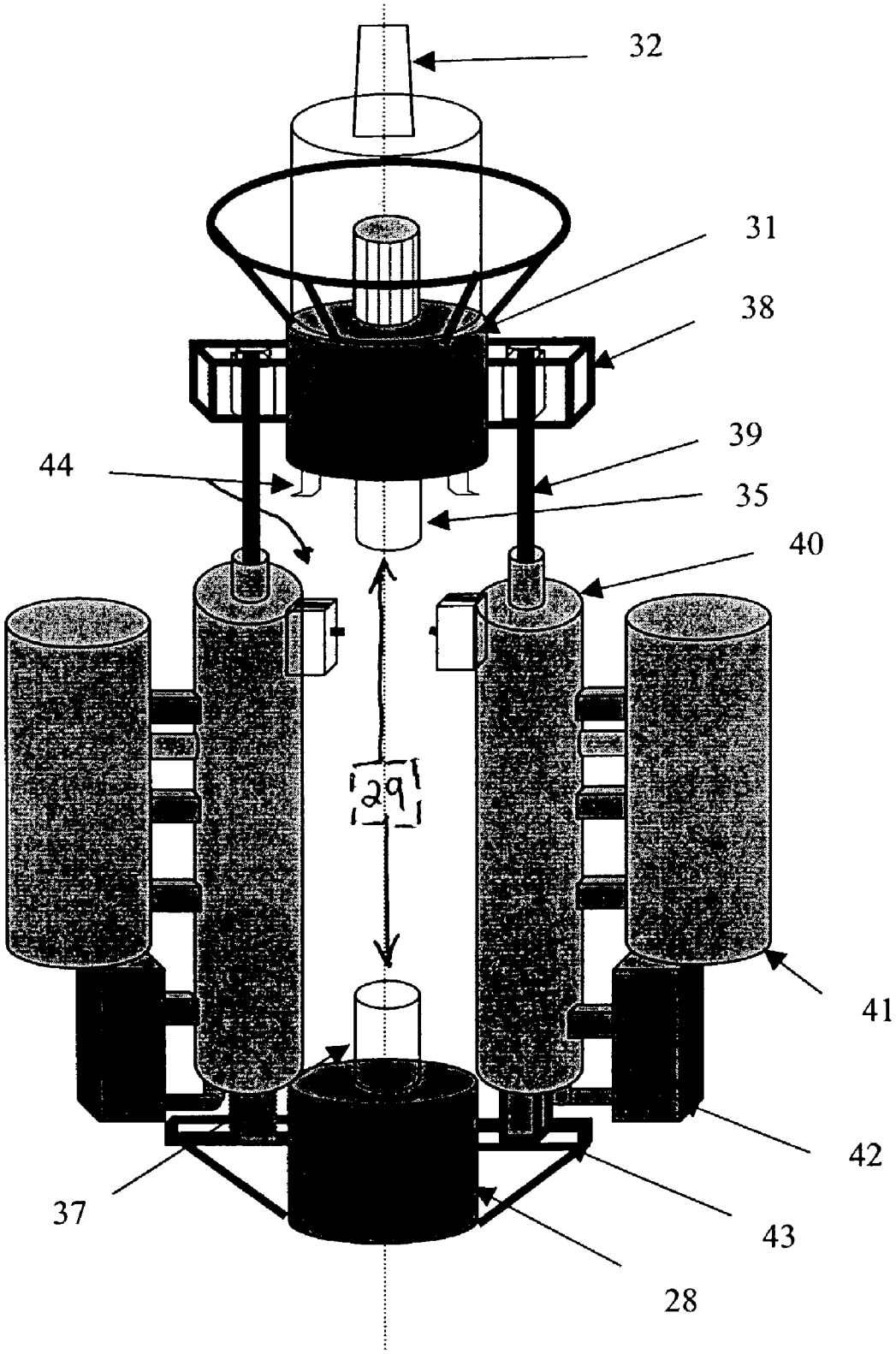
FIG. 4 shows an enlarged elevation view of the invention with the Coil Section removed.
Figure 5:
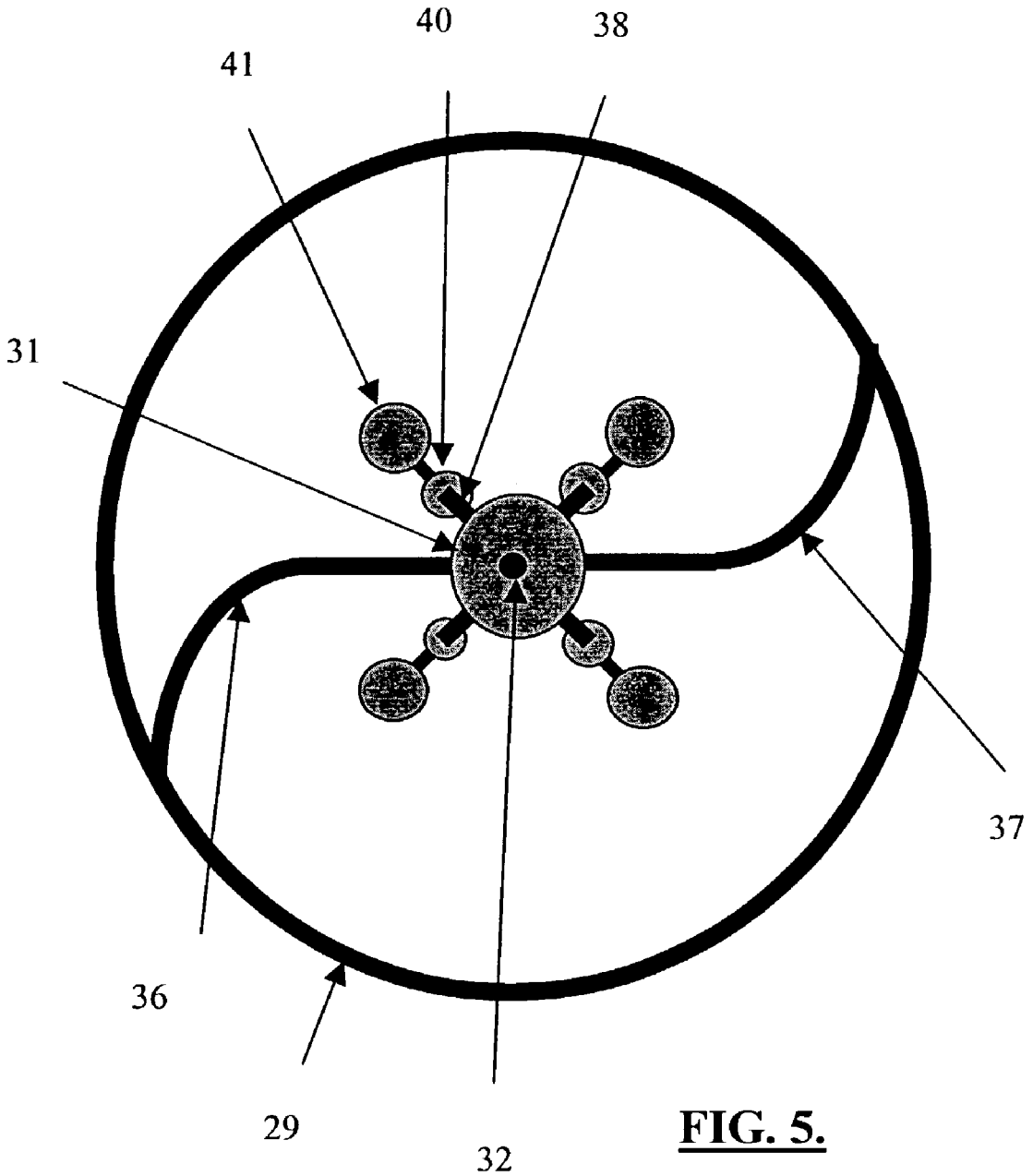
FIG. 5 depicts a top view of the apparatus shown in FIG. 4.

FIG. 4 and FIG. 5 show the BTR system 25 with the Coil Section removed. There are four tensioning units 40. A tensioning rod 39 extends from each unit and is mechanically connected to the upper structure and connector 38. An auxiliary tensioning pressure unit 41 and a sea chest 42 are joined to the main body of the tensioning unit 40. The main body of the tensioning unit is connected to the lower structure and connector 43.

Figure 6:
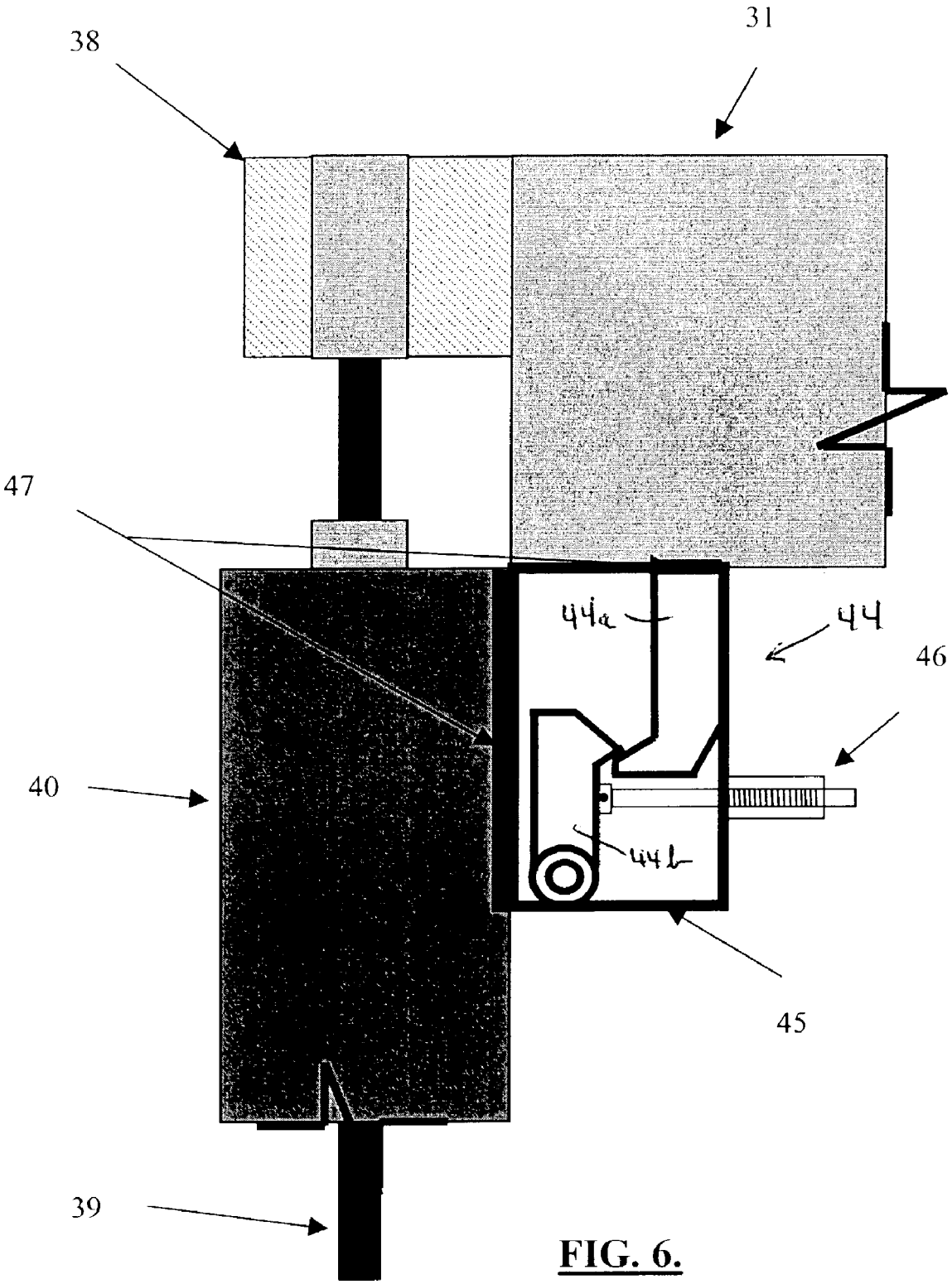
FIG. 6 shows the locking mechanism in its locked position.
Figure 7:
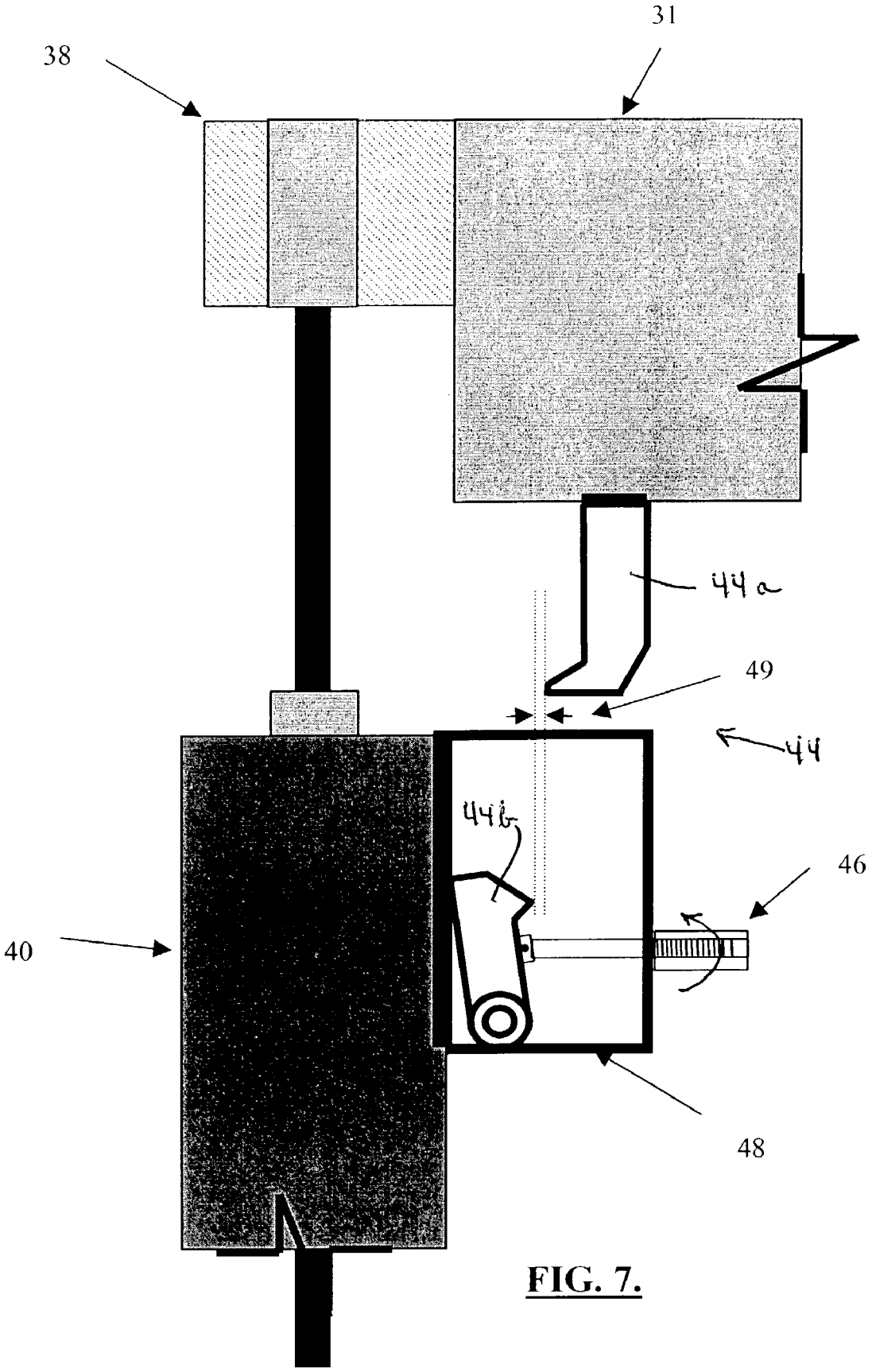
FIG. 7 shows the locking mechanism in its un-locked position.

The locking mechanism 44 is shown in FIG. 6 and FIG. 7. FIG. 6 shows the mechanism in the "locked" position. FIG. 7 shows the mechanism in the "open" position. The locking mechanism mechanically connects the main body of a tensioning unit 40 with the upper connector 31. The mechanism comprises a fixed pawl 44*a* is connected to the upper connector 31. Another pawl 44*b* is pivotally connected to the tensioning unit 40. The free end of that pawl 44*b* is moved towards and away from the free end of the fixed pawl 44*a* by means of a locking screw 46 that is preferably configured to be operated by a Remotely Operated Vehicle (ROV). Thus, when the screw 46 is advanced toward the pivoted pawl 44*b*, the two pawls separate. A clearance tolerance 49 allows the upper connector 31 to move away from the main body of the tensioning unit 40.

The BTR system 25 is unique in at least four important ways:

First, it provides the means for providing top tension at the Host Facility in a way that tensile stresses remain relatively low throughout the range of Host Facility offsets. This is important because it ensures that riser integrity can be maintained as the Host Facility moves about.

Second, the stroke length requirement is provided via the Coil Section, which is contained within the lower section of the riser. Thus, the BTR system remains essentially transparent to the design of the hull and topsides. This is important because it simplifies hull and topsides designs.

Third, since this is a vertical riser system, it projects a relatively small footprint onto the seabed. This is important, particularly for those field developments that use of subsea wells and equipment that are located under the Host Facility. In these situations, the BTR approaches being an "enabling technology". This is because there is only limited space at the seabed to accommodate the system and seabed equipment architecture needs.

Fourth, the BTR concept can be configured so that it is a "forgiving" arrangement, with minor cost increase to do so. Forgiving in this context refers to those situations in which the Host Facility could be displaced beyond its expected limits. The importance of the BTR system is that the Coil Section 27 can be provided with a conservative stroke length to account for this possibility. The reason that this is feasible is that unlike the topsides, where interface limits measure in inches between the riser and topsides equipment, ample headroom exists at the lower section of the riser. This feature allows many optimizing opportunities for the BTR system.

Moving on to the BTR rod and piston elements there are at least two basic approaches that can be used for this part of the system.

Figure 8C:
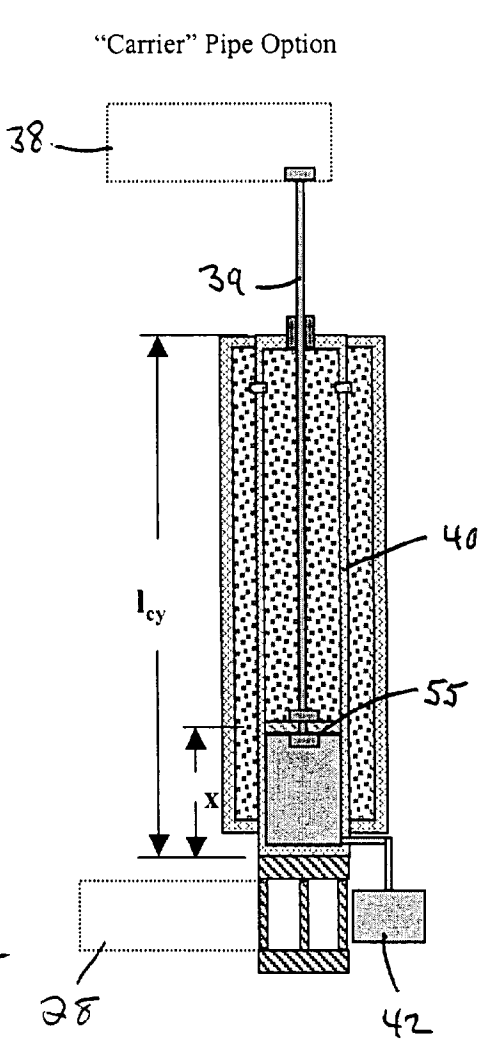
FIG. 8 depicts three optional arrangements of the BTR assembly.

The first approach is to use a "closed" arrangement for the pressurized gas that is used in the cylinder and rod assembly. This method is represented in FIG. 8A. The gas is installed at a pre-determined pressure, and the pressure in the cylinder increases or decreases as the rod and piston move up or down, respectively. This approach has the advantage that it is cost efficient, but it may require occasional intervention to replenish the gas. In the event of component failure, removal and repair or replacement of the unit may be necessary. However, this design can provide an efficient solution. It is the basis that is used for developing the riser top tensile stress computations that are shown in FIG. E-4(b) of the U.S. Provisional Patent Application Ser. No. 60/375,619 filed on Apr. 26, 2002 This approach results in tensile stress increase, primarily as the Host Facility approaches maximum offset limits. Even so, the related maximum tensile stress remains well within acceptable limits. Most of the time, Host Facility offsets will be much less than the extreme offsets, and the tensile stress change is quite small.

Figure 8B:
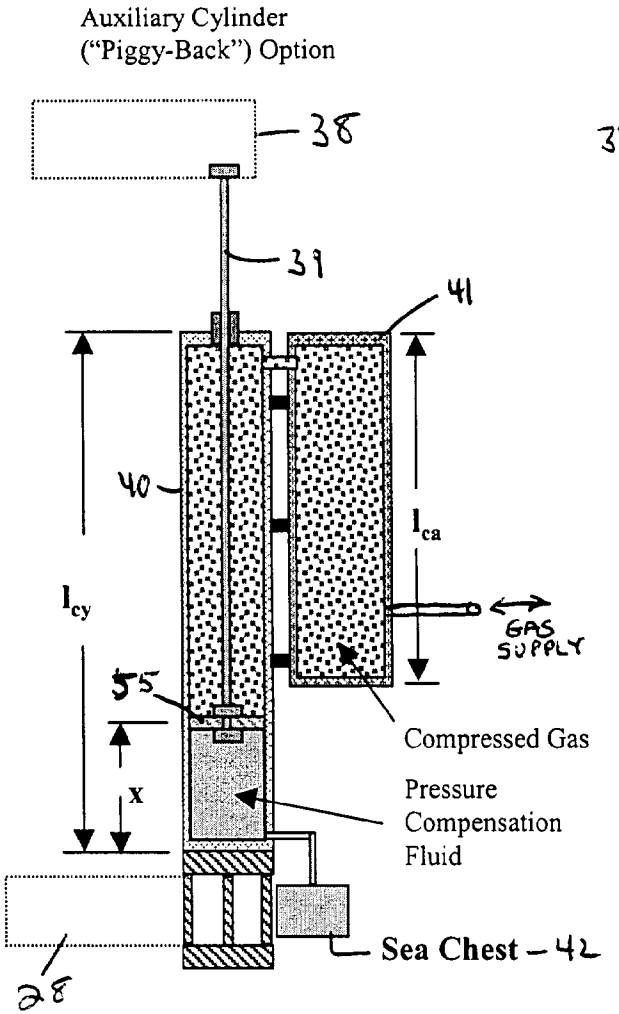
Figure 8A:
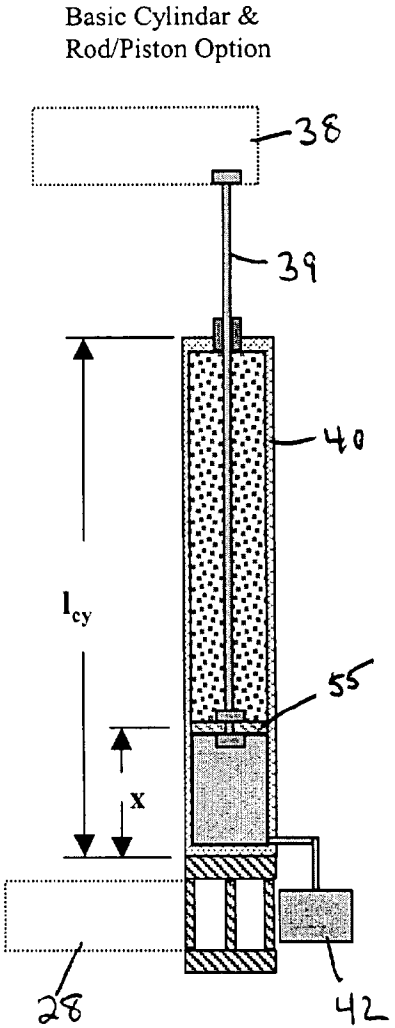

The second approach is to use an "open" system for the pressurized gas that is used in the cylinder and rod assembly This method is represented in FIG. 8B. This approach has the advantage that a constant level of gas pressure can be applied via the Host Facility, resulting in the capability to maintain a near constant level of pressure on the cylinder and rod piston. This allows maintaining a more constant top tensile stress at the top of the riser throughout the range of Host Facility movements. However, this additional capability comes at considerable additional cost and complexity, with near certainty that the frequency of component failure, removal or replacement of the unit is expected to be little different than for the closed system approach. Due to the added complexity of this system, it could even require more frequent intervention than for the closed system approach. In any case, these are the reasons why the closed system approach is assumed for this BTR concept assessment.

FIG. 8C shows another variation of the "open system" approach wherein an auxiliary cylinder 41 is co-axial with the main cylinder 40. Details of the comparison of different cylinder, rod, piston, and auxiliary cylinder configurations are provided in the Appendix II. The "piggy-back" auxiliary cylinder method is beloved to provide the most efficient solution for the cylinder volumes required for this type of application.

Dynamics

This invention has immediate application to situations where top tensioned risers have been used to transfer products between a floating Host Facility and the seabed for deepwater oil and gas field developments. Referring to FIG. 2, there are two basic elements.

The first element is placement of the top tensioning equipment in the lower portion of the riser rather than at the top of the riser. By placing this equipment at the bottom of the riser system, the tensioning assembly is subjected to lower loads than when the tensioning assembly is placed at the top of the riser. This load reduction is roughly equal to the riser weight in water.

The second element is the use of a Coil Section 27 that lengthens and shortens to accommodate the Host Facility movements. In addition to this, it provides the required riser top tension to maintain riser integrity. By virtue of this invention, the need for large, complex, and costly top tensioning equipment at the interface with the Host Facility is eliminated. Since the Coil Section is placed at the bottom of the riser, it can accommodate most any Host Facility motions that fall within the practicalities of building, transporting and installing the Coil Section.

The BTR system global geometry is summarized in FIG. 9. There are three important aspects of the riser system:

1. installation,
2. performance at the Host Facility neutral position, and
3. performance at Host Facility offset positions, including possible extreme events.

Figures 9A, 9B, 9C:
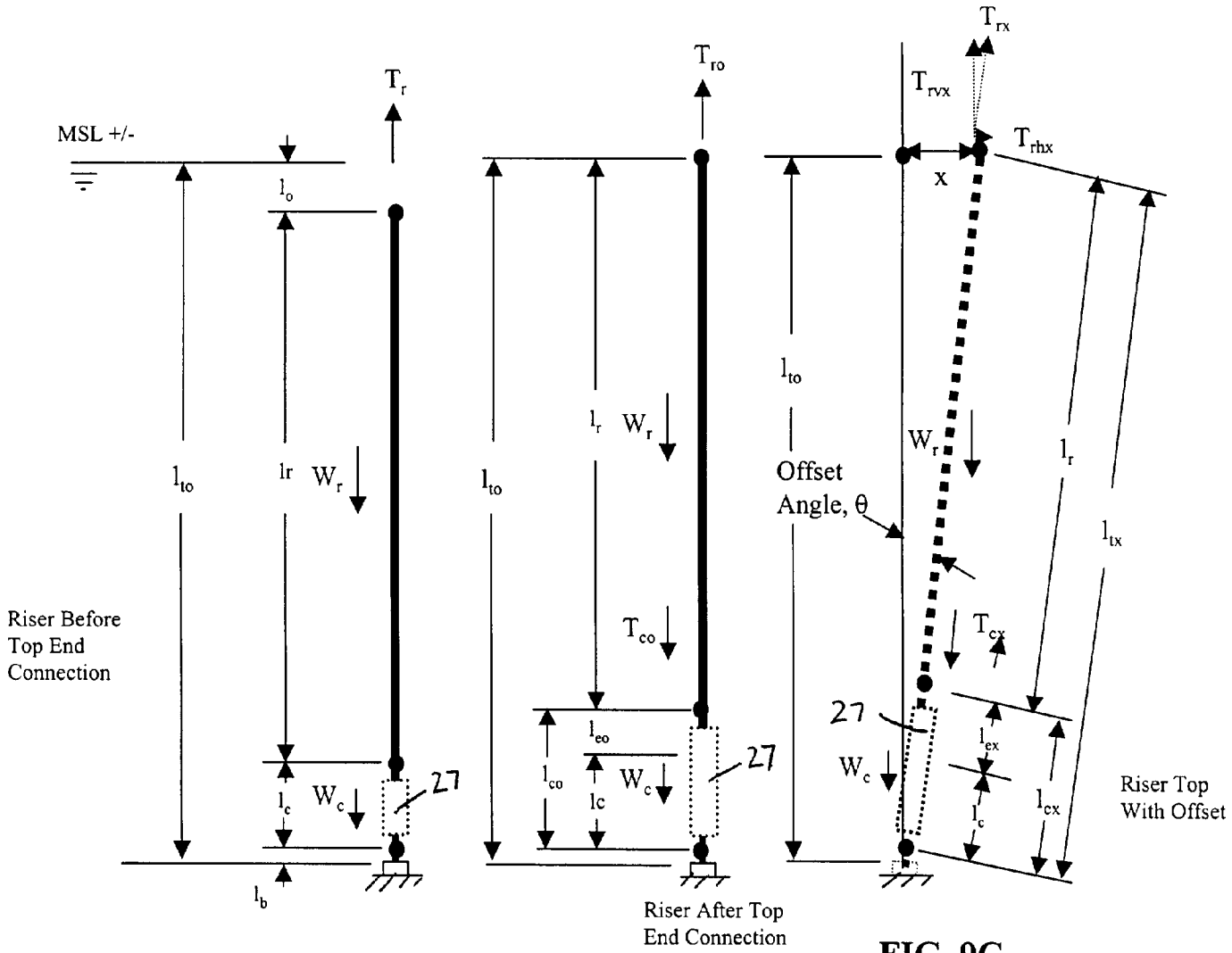
FIG. 9 shows the basic global geometry of the BTR.

Turning to system installation, this is represented by FIG. 9A. The overall riser length is $l_{to}$ for a given water depth. The main riser section, which will make up most of the riser system, will have a riser section length, $l_r$. As can be seen, it is the length of the riser system (excluding the height of the riser base and Coil Section above the seabed). This main part of the riser is commonly made from steel, but other materials, such as titanium, have been used. The weight of this riser during installation will include its weight in water during installation, and that of the Coil Section weight, $W_c$. After installation, the weight of product carried within the riser will be also need to be included. These riser weights are represented by $W_r$.

Before lowering the main riser section to the seafloor, the Coil Section of length $l_c$ and self-weight in water $W_c$ is attached to the riser. Since the Coil Section 27 is attached to the lower section of the main riser, the Coil Section carries only its own weight and that of the riser bottom connector and any special riser or subsea components that may be necessary for a specific application. This results in the riser system that is short of its final installed length by the value $l_o$. The riser top tension at this point is $T_r$. Once the riser system is landed and locked onto the riser base, the riser system is pre-tensioned to provide a pre-determined riser top tension, $T_{ro}$. This is performed in conjunction with docking the riser top into the riser top connector that is provided on the Host Facility. At this point, the Coil Section is extended by the length $l_{eo}$, resulting in the Coil Section tension load $T_{co}$ that causes the riser system top to increase to $T_{ro}$. The connected and pre-tensioned riser system is represented by FIG. 9B. These riser system installation activities described herein are typical of those that are used when installing many types of deepwater equipment.

Performance at the Host Facility neutral position will now be addressed. At the Host Facility neutral, or no offset position, environmental responses and operational load changes will cause the need for riser length changes to occur. Also at this position, the riser top tension should be sufficient to ensure appropriate riser system behavior through the long water column. Maintaining the riser top tension to an amount that is somewhat more than the weight of the riser system does this. The pre-tensioning as described above causes the Coil Section length to increase from its original length $l_C$ by an amount $l_{eo}$. This results in the Coil Section length $l_{CO}$ at the neutral position. This pre-tensioning load is transmitted directly through the main riser body and into the riser top connector, resulting in the total riser top tension, $T_{ro}$. Thus, as Host Facility motions or operating loads change, the Coil Section length $l_{eo}$ also changes accordingly.

Performance at the Host Facility offset positions will now be addressed. The third set of conditions that the riser system should satisfy is represented in FIG. 9C. These conditions occur when the Host Facility moves laterally from it neutral position. During a possible extreme event, this offset can approach in excess of five percent of the water depth. From a riser system configuration standpoint, all motions are important. But of these motions, the most important is the Host Facility extreme offset conditions. In an area like the Gulf of Mexico, hurricanes normally define the extreme events, which in turn determine the Host Facility maximum offset. However, in some situations, the Host Facility may be offset even more than this for system operating purposes. If this is so, this need should also be accounted for in the riser system configuration. During hurricane events, Host Facilities are commonly de-manned. During these periods, the riser system should continue to perform without any requirement for man-machine interaction. The offset x, as shown in FIG. 9C, is used to represent all Host Facility and the connected riser system lateral displacements. Since a moored, floating body experiences six degrees of motion, and not just the single degree of freedom motion (x offset) that is represented in this drawing, additional allowance for the other five degrees of motion is necessary in actual practice. However, since x is the most significant single item, a first approximation of the change in riser system length can be defined using equations (1), (2) and (3):

$$\tan^{-1}(x/l_{to})=\theta \quad (1)$$

$$\cos(\theta)=l_{to}/l_{tx} \quad (2)$$

$$l_{tx}=l_{to}/\cos(\theta) \quad (3)$$

$$l_{ex}=l_{tx}-(l_r+l_c) \quad (4)$$

The main riser body length $l_r$ is essentially unchanged as the Host Facility offsets from its neutral position. The Coil Section length extends beyond its neutral position length $l_{eo}$ to satisfy the extreme event Coil Section extension length $l_{ex}$, as shown in equation (4). This results in a total Coil Section extended length of $l_{cx}$ and riser system length of $l_{tx}$ for the extreme offset conditions. These same relationships can be used to characterize the riser system throughout the range of Host Facility offset positions between the neutral and maximum positions. The Coil Section is a key part of the BTR system. It is now described in more detail.

The export and import riser duty of the BTR system should satisfy specific Industry Practice design features. The overall Coil Section assembly is shown in FIG. 2. It consists of the upper and lower connectors 31 and 28, the Coil Section 27, and the tensioning unit 40. The connectors are commercially available components today, so they are not be described in detail. However, the way in which the connectors are configured to meet the specific requirements of the BTR Coil Section is unique, and their use in this way is included in this application. The main Coil Section is described first, followed by the tensioning unit and the complete assembly.

The Coil Assembly is shown in FIG. 3. As shown in the plan and elevation views, it consists of six components.

The first two components are the upper connector 31 and lower connector 28. Each connector is required to provide the structural strength that is needed to transmit loads and provide pressure isolation for the riser production as it is moved from the main riser body into the riser base. These connectors are commercially available today, so no further description is necessary.

The next component is the Pipe Section 35 for the Tensioning Assembly 30. The Pipe Section 35 is an engineered segment of pipe that provides the attachment to the bottom of the upper connector 31 and the top of the Upper Coil Transition Section 36 (described later). The Pipe Section 35 serves two purposes. The first purpose is to provide a length of pipe that reduces the number of individual coils to the minimum number of coils that are needed in the Coil Section 27. For most situations, excluding Pipe Section 35 would result in the need for using more coils than is required to meet the Coil Section maximum stroke length. The Pipe Section 35 provides design efficiency for each application. The second purpose for Pipe Section 35 is to provide the strength that is needed to expand the coils while providing pressure isolation for the riser products.

Figure 10:
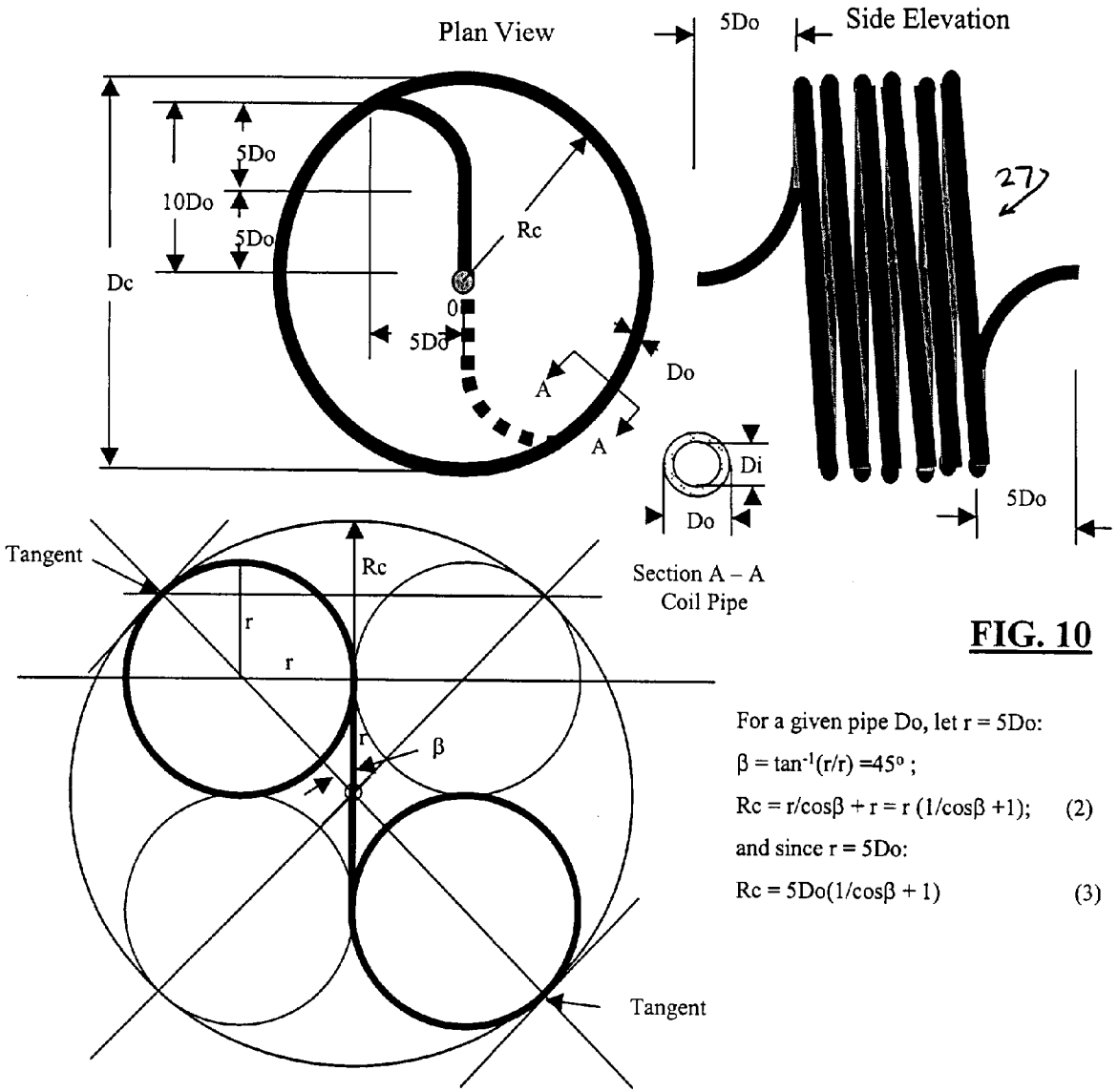
FIG. 10 depicts minimum coil diameter consistent with 5Do pipe bends.

The next component of the Coil Section 27 is the Upper Coil Transition Section 36. It is connected to the bottom of the Pipe Section 35 and the uppermost coil. The Upper Coil Transition Section 36 has two purposes. The first is to provide the strength that is required to expand the uppermost of the coils while providing pressure isolation for the riser products. The second purpose is to provide this transition in accordance with Industry Practices for export and import pipelines. Basically, this means that the Upper Coil Transition Section 36 will have a minimum pipe bend limit throughout its own shape and as it makes the tangential transition into the connection with the uppermost of the coils. FIG. 10 shows one way in which the Industry Practice for minimum bend radius criteria determines the geometry of both the Upper Coil Transition Section 36 and the main coils.

The engineered coils are the next components of the Coil Assembly. These coils have two purposes: The first purpose is to provide the flexibility that will satisfy the stroke length changes that will be required by the riser system as the Host Facility moves. The second purpose is to provide pressure isolation for the riser products between the Upper Coil Transition Section 36 and the Lower Coil Transition Section 37.

The last component of the Coil Assembly is the Lower Coil Transition Section 27. It bridges between the coils and directly to the Lower Connector 28. The purposes for the Lower Transition Section 5 and the Lower Connector 28 are the same as those described for the Upper Connector 31 and the Upper Coil Transition Section 36. As an assembled unit, the six components of the Coil Assembly will have a structural stiffness modulus as the assembly length changes. This Coil Assembly stiffness modulus is to be considered in conjunction with the Tensioning Assembly that is shown in FIG. 4.

Referring to FIGS. 4 and 5, the Tensioning Assembly the main body of a Riser Pipe 32 is attached to the Upper Connector 31. Also, an engineered Upper Structure and Connector 38 is attached to the Upper Connector 31. The Upper Structure and Connector 38 has two functions: The first function is to transmit the forces from a Tensioning Rod 39 to the Upper Connector 31. The second function is to provide a proper connection for the Tensioning Rod 39.

In one embodiment, this connection has a gimble configuration so that the Tensioning Rod 39 can perform properly. The displacement that occurs at the top of the overall Coil Section is expected to be more than the displacement that occurs at the bottom. This occurs because the base of the Coil Section is fixed by the Lower Connector 28 attachment to the riser base 26, while the top of the Coil Section 27 responds to main riser length changes and offsets. This gimble arrangement can also be configured so that the Tensioning Rod 39 can be disconnected using subsea intervention practice. The reason for this is so that individual Tensioning Units 40 can be recovered for repair or replacement without having to recover and replace the entire Tensioning Assembly 30. As will be explained later, the force that is developed by the Tensioning Rod 39 is provided by compression of gas that is acting on the piston 55 that is attached to the lower end of it, and confined within the Tensioning Unit 40.

Each Tensioning Unit 40 is configured so that it is long enough to satisfy the particular application stroke needs, including additional length that may be considered appropriate by the system designers. The diameter of this cylinder is determined by the combination of contained gas compression pressure that is acting on the Tensioning Rod 39 piston's net area and the Tensioning Rod's tensile force that is required for the application. It is this Tensioning Rod tensile force, working in unison with the rods of the other Tensioning Units' rods' tensile forces that provides a significant portion of the Coil Section 27 stiffness modulus that is required as the system stroke length changes take place.

The Tensioning Auxiliary Pressure Unit 41 is an integral element to the Tensioning Unit 40. This unit provides additional compressed gas volume that is in direct communication with that of the Tensioning Unit's compressed gas volume. This configuration permits the Tensioning Rod 39 to make the long stroke length changes without causing excessive compressed gas pressure changes. If this were not performed in this way, the rod load changes could be excessive, resulting in excessive changes in the riser top tension, which could lead to riser fatigue failure. The positioning of the individual Tensioning Units 40 around the Upper and Lower Connectors 31 and 28 is important. As a minimum, they should be placed so that they work in unison. This will prevent any excessive unbalanced loads on these two connectors 31 and 28. Since the Host Facility lateral movements can occur in any direction, the number of Tensioning Units 40 and their placement should preferably satisfy this requirement. Evaluation of each application will reveal the appropriate arrangement.

FIG. 5 shows a representative plan view of an assembled Coil Section 27 that uses four Tensioning Units 40. As shown in FIG. 4 and FIG. 8, the Tensioning Unit 40 is also provided with a Sea Chest 42. It is connected to the underside of the rod piston element that is contained within the Tensioning Unit 40. The Sea Chest 42 provides the important function of pressure balancing the Tensioning Unit 40. Local seawater pressure will be allowed to act on the underside of the rod piston and on the top of the rod. By using this pressure compensation method, the compressed gas pressure that is required to charge the cylinder of Tensioning Unit 40 and the cylinder of Tensioning Auxiliary Pressure Unit 41 is reduced roughly by the equivalent seawater pressure at the application depth. This provides important design and system performance efficiency. The Sea Chest 42 can be used to provide an inhibited fluid that is displaced into and out of the underside of the Tensioning Rod 39 and its connected piston as it moves in and out of the cylinder of the Tensioning Unit 40 in response to the Host Facility movements. This arrangement not only serves to eliminate the possibility for hydraulic block of the mechanism, but it reduces the possibility for unwanted corrosion or debris from affecting performance of the Tensioning Unit. At the base of the Tensioning Unit, the Lower Structure Connector 43 is provided. This item transmits Tensioning Unit 40 loads into the Lower Connector 28. Preferably, it will have a gimble feature and disconnect capability for the same reasons as described previously for the Upper Structure 38.

Operation

Referring to FIG. 1 through FIG. 5, the way in which the Coil Section 27 works will now be summarized. The lower connector 28 is attached to a mating connector that is contained within a riser base. The riser base is structurally attached to the seabed, resulting in the lower connector 28 being a fixed point that is near the seabed. The bottom of the main riser pipe contains a mating connector for the upper connector 31.

As the Host Facility moves, the top of the main riser pipe, which is connected directly to the Host Facility, moves with it. This movement is transmitted immediately via the main riser pipe into the Upper Connector 31. This causes the spacing of the Coil Section coils to increase for Host Facility motions that tend to make the riser system length increase. As this coil spacing increases, coils provide a resisting force to the movement that is transmitted into the upper Connector 31. Also, the tensile force of the tensioning rod 39 of the Tensioning Unit 40 is maintained, increasing somewhat as coil spacing increases. This action maintains a near constant load that also resists this Main Riser pipe movement, as the load is transmitted into the upper connector 31. The load of the combined coils and Tensioning Units' 40 are transmitted into the Upper Connector 31, and are in turn transmitted into the main body of the riser pipe. This Coil Section and main riser pipe loading increase results in an increasing tension load at both the bottom and the top of the riser that is predictable for the riser system. This helps ensure riser system design integrity. Since the fundamental purpose for the riser system is to provide pressure isolation for the fluid that is transmitted through it, maintaining this riser integrity is important. For Host Facility movements that tend to shorten the riser system length, the changes that occur are exactly the opposite of those changes that were just described for movements that tend to lengthen the riser system.

This concludes the detailed description of the Bottom Tensioned Riser system. By placing the top tensioning equipment in the lower section of a deepwater riser, the loads that are carried by the Tensioning System are reduced by an amount that is roughly equal to the weight of the riser in water. Moreover, a Coil Section 27, which is placed in the lower part of a riser, can be used to efficiently control riser top tension loads while accommodating the Host Facility motions.

Representative BTR System examples are further discussed in Appendix I and Appendix II. The results of Model Experiments are provided in Appendix III. A rudimentary description of the installation of a BTR System is presented in Appendix VI.

Scope

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the shape, materials, size and arrangement of parts. Deepwater production risers range in pipe diameters from 3-inch through 36-inch. They are used in water depths (length) ranging from a few thousand feet to more than ten thousand feet. Carried fluid internal pressure may range from 1,000 psi to more than 20,000 psi.

Moreover, equivalent elements may be substituted for those illustrated and described. Parts may be reversed and certain features of the invention may be used independently of other features of the invention. For example, the common application for the BTR System will be steel and steel alloy materials. Other metallic materials, such as titanium, can be used. Composite type materials, such as those that are based on high strength, lightweight strands like Kevlar, also may be used in the future. The invention may also have applicability to the Ocean Thermal Research Program. It may ultimately lead to the need for long life and deep risers that are suspended from a surface facility. These risers also need be to be stabilized against lateral current forces, while managing riser top tensioning loads. This is just what the BTR System does. However, as presently configured, the BTR System is for high pressures and relatively low rates. Energy recovery that is based on the temperature differences between shallow water and deepwater will likely require very high seawater throughput rates at low pressures. The BTR System configuration may look different, but the principles would be the same. Thus, it will be appreciated that various modifications, alternatives, variations, and changes may be made without departing from the spirit and scope of the invention as defined in the appended claims. It is, of course, intended to cover by the appended claims all such modifications involved within the scope of the claims.

Appendix I

Worked Examples of Bottom Tensioned Riser (BTR) System

Referring to Appendix FIG. 1, the U.S. Provisional Patent Application filed on Apr. 26, 2002 under Ser. No. 60/375,619, the BTR System and its key relationships are shown. These relationships are used in Appendix Table 1. All subsequent references to figures and tables in this appendix will be with respect to the U.S. Provisional Patent Application filed on Apr. 26, 2002 under Ser. No. 60/375,619. The examples provide simple static solutions for 4-inch through 14-inch riser and Coil Section pipe sizes in 6000 feet of water. This type of global, static solution information is representative for the initial riser approximations. Thus, the solutions are only indicative of the first step forward for doing a full riser analysis and design. These subsequent steps, which are beyond the scope of concept feasibility assessment, should include appropriate riser dynamic analysis in the frequency and time domains, use the predicted hull motions at the Host Facility attachment point, and apply appropriate hydrodynamic and modeling for the riser system. Also, static and transient multiphase product hydraulic simulations, and inclusion of the riser changes that will occur as a result of related thermal effects—especially for high temperature and pressure conditions will require analysis. However, based on previous experience, it is believed that these simple initial static results are sufficiently representative to reach conclusions about this new riser concept based on the results of these worked examples.

Referring to Appendix Table 1, this initial information results in the wall thickness estimate for a given grade of material, which is steel of Grade X60 in this case. The pipe code that is used is B31.4, with the wall thickness shown for each of the line sizes. For convenience, it is assumed that the riser pipe and coil pipe is made using the same material. It is feasible to use different materials for each, and this could result in optimized solutions. The single coil properties are defined, and items are specified or calculated as shown in the Table. Where applicable, the specific figure number and equation that is used to do each calculation is provided for reference. The global system parameters are then specified for the particular case. This provides an estimate for the number of individual coils that are required to satisfy these global conditions, and the Stiffness Modulus for the number of pipe coils that are used in the Coil Section. As described earlier, these are approximate solutions only. The reason is that engineering solutions for this type of system are not yet matured for detailed design purposes. The next section provides the calculations for the Tensioning Units that are used with the Coil Section 27. This case assumes that a "closed system" is used for the cylinder and rod piston elements, along with an auxiliary cylinder. This is performed to efficiently manage the gas compression. Further discussion about this is provided in Appendix II.

The focus on this work has been primarily on the 12-inch riser size, so the tensioning assembly sizes and rod forces are best suited to using four of these tensioning units. As can be seen in Appendix Table 1, the number of units is artificially reduced for the smaller sizes. If this were not performed, riser top tension loads would be too high because the tensioning unit rod loads would be too high. In actual practice, smaller tensioning units would be configured so that a minimum of three units, perhaps four would be used. The larger number of units is necessary to ensure that the rod loads are properly distributed around the Coil Section top connector. For this work, it is assumed that the rod piston cylinders are completely efficient. This is rarely a good assumption, and it is common engineering practice to handle this matter during detailed design of equipment. With the Tensioning Unit Stiffness Modulus determined, the overall Coil Section Stiffness Modulus is then established, accounting for the stiffness of both the coils and the tensioning units. The Stiffness Modulus for the Riser Pipe itself is then calculated as referenced in the Table. The combined Stiffness Modulus for the Riser Pipe and the Coil Section 27 is also calculated as shown in the Table.

The weights that are represented in this Table are essentially solutions in air. In actual practice, a very wide range of weights will be possible in a given situation. This is because individual pipes will displace a volume of seawater, and buoyant forces will partially offset the pipe weight in air. However, the product in the riser will add weight, while coatings added to the pipe usually decrease the pipe weight in water. Experience has shown that for initial approximations, just using the pipe weight in air is a reasonable initial assumption pending availability of detailed information. It is believed that this weight in air assumption will provide reasonable first approximations for assessing the BTR System.

With the riser system stiffness modulus established, the conditions for the riser when the Host Facility is in the neutral, or no offset position are satisfied. The means for doing this is to apply an initial top tension in the riser that exceeds the weight of the riser itself. This allows the Host Facility to move around in its neutral position, and it provides a top tension load that exceeds the riser self weight. This additional tension is needed to structurally stabilize the riser during the wide range of environmental loadings to which it will be subjected, even when the Host Facility as at or near its no offset position. For this case, it is assumed that one third of the Coil Section 27 extension capability is used to provide this pre-tensioning. This fixes the top tensile stress in the riser at the level at which it will be for the predominant time period of its useful life. These calculations are shown in Appendix Table 1. Similarly, the next condition that should be satisfied is when the Host Facility is offset to its predicted extreme offset position. These calculations, including the resulting riser top tensile stress, are shown in the Table.

Maintaining a consistent set of assumptions, these calculations can be repeated for a wide range of possible water depths. An example for a 12-inch BTR System is provided in Appendix FIG. 2. This is performed to demonstrate that the BTR concept is suitable for a wide range of water depths. Use of the closed system Tensioning Unit method causes the riser top tensile stress to increase as the Host Facility moves from the no offset position to the maximum offset position. This appears to be a manageable level of stress increase. However, if detailed riser design determines that this is not acceptable, an open system Tensioning Unit can be used to maintain a near constant riser top tensile stress across the range of Host Facility movements. However, this open system Tensioning Unit design is expected to add complexity and cost to the BTR System.

A few final comments are provided about the loads that will occur at the lower end of the BTR System. The Coil Section 27 will be subjected to a wide range of loads. Since it is located under the main riser body, these loads will be relatively small. This is why the focus of this discussion is the riser top loads, which are quite large in deep water. Even so, the Coil Section loads should be properly identified and detailed designs provided to meet these load conditions. When these bottom-located Coil Section loads are compared to those of a comparable surface located, stroke-providing tensioning unit, where the surface unit carries the riser weight and its over pull, the true value of a BTR riser system and the Coil Section design becomes immediately apparent. Since the Coil Section is located at the bottom of the riser, the impact of providing a long stroke unit is minimal. Providing a long stroke unit at the surface is costly, and interfacing a unit like this with the topsides can become complex to the extent that it may not be feasible to do it.

Appendix II

Tensioning Assembly Cylinder and Rod Piston Configurations and Comparisons

This is a summary of the work that was performed to select one preferred configuration for a Coil Section 27 closed system Tensioning Unit. There are three fundamental ways in which a subsea cylinder and rod piston unit can be configured. These three methods are represented in Appendix FIG. 3 and FIG. 8 herein. Unless otherwise indicated, all references to figures and tables in this appendix will be with respect to the U.S. Provisional Patent Application filed on Apr. 26, 2002 under Ser. No. 60/375,619.

A basic cylinder and piston rod option is shown in FIG. 8A. The work that was performed previously in conjunction with the Coil Section 27 load determination established representative types of rod loads and stroke lengths that would be needed for a Tensioning Unit. The focus of this effort was on a 12-inch riser pipe size for 6000 feet of water. This provided first approximations of a required rod force of between 100,000 pounds and 130,000 pounds (when combined with coil properties and four tensioning units, this will result in top tension loads (over pull) up to about 500,000 pounds. At 6000 feet, the required stroke length is about 360 inches. For the purposes of this work, a minimum stroke length of 480 inches was assumed.

In a perfectly pressure compensated system (i.e., frictionless), gas pre-charge at the surface can be performed so that the cylinder pressure at subsea application depth is exactly the same as it is at the surface (See FIG. D-13, equations (1) through (3)). Thus, cylinder wall thickness requirements can be determined for the application. In an actual design, a higher gas pre-charge than the "perfect" pressure would be used. This is performed because some extra pressure is required subsea for two reasons: First, the rod lubricator that is located at the top of the cylinder, and the rod piston element, where it contacts the cylinder wall, exhibit real world friction that must be overcome. Second, the rod is long and slender. Thus, the piston force should be kept high enough that it ensures that the rod will be "pulled" into the cylinder, and not "pushed" into it as the Tensioning Unit stroke is decreasing. If the rod were pushed, it could easily buckle. This could lead to failure of the Rod and Cylinder. For this comparison, the perfect gas pre-charge pressure is assumed for all options, recognizing that all configurations will require a pressure greater than this for actual design.

As can be seen in Appendix FIG. 3 and FIG. 8 herein, as the piston rod is stroked out, the gas in the cylinder is compressed. The solution to this problem is easily determined using the compressed gas pressure that will not over pressure the cylinder or over stress the rod as it develops the required tension load as it approaches the required rod stroke length.

Appendix FIG. 4 provides the results of this solution for the basic cylinder and piston rod option of FIG. 8A herein. However, as shown in Appendix FIG. 4, the cylinder length is twice as long as the stroke length objective of 480 inches to prevent over pressuring the cylinder.

The auxiliary cylinder option uses an auxiliary cylinder and is shown in the middle of Appendix FIG. 3 and FIG. 8B herein. This configuration achieves the same purpose as the first option, but because the added gas compression volume is provided in parallel, the cylinder pressure increases more slowly. The results of this solution are shown in Appendix FIG. 5. The configuration length remains within the stroke length objective of 480 inches.

A "carrier pipe" option, which is basically placing the main cylinder within another cylinder to provide the added gas compression volume in parallel to the main cylinder, is shown on the right side of Appendix FIG. 3 and FIG. 8C herein. The results for this solution are provided in Appendix FIG. 6. The configuration length remains within the stroke length objective of 480 inches.

An overall summary comparison of the "attributes" for these three Tensioning Unit options is provided in Appendix FIG. 7. It is clear that the configuration that is represented in the middle of Appendix FIG. 3 is the preferred way to approach the design for the Tensioning Unit assemblies.

In closing on this topic, it should be noted that no allowance has been made for the weight of these Tensioning Units in the Coil Section 27 weight estimate. The reason for this is the possibility that these units will be of very low weight in water, perhaps even buoyant (tendency to float). At this point, it is thought conservative to exclude their weight from the example calculations.

Appendix III

Summary of Model Experiments

A series of simple, but representative, experiments were performed to assess the BTR concept. The experimental set-up is shown in FIG. C-1 of the U.S. Provisional Patent Application filed on Apr. 26, 2002 under Ser. No. 60/375,619. All subsequent references to figures and tables in this Appendix will be with respect to the U.S. Provisional Patent Application filed on Apr. 26, 2002 under Ser. No. 60/375,619. Each Experiment is characterized by investigating the physical deflection of the Coil Section 27 with different weights attached to the apparatus. The primary difference between each of the experiments is a change in the Coil Section diameter. For each Test Condition, engineering calculations were performed based on representative materials and the model geometry. These measured and calculated results were then compared to one another. Results of the Experiments are summarized in Appendix FIG. C-2 through Appendix FIG. C-22. The following conclusions may be made:

First, the calculated deflection values (Coil Section stretch) were consistently over-predicted. By direct inference, this resulted in consistent under-prediction of the Coil Section Modulus K.

Second, at very low loadings on the model, the Coil Section Modulus values demonstrated significant high variations. Some of this can be readily explained by limitations of the model apparatus, such as friction on the weight/pulley assembly being inconsistent. Regardless, low-load measurements are suspect.

Third, at higher end loadings, the convergence of Coil Section Modulus measured and calculated value seems to be more consistent. However, the Coil Section tends to retain more of its stretched length with the higher loads. Even so, the Coil Section appears to retain its basic modulus value. This aspect warrants further investigation before any full-scale application is considered.

Fourth, the agreement between measured and calculated deflections across Coil Section diameters supports the basic analytical procedures. Given that general engineering handbook properties are assumed representative for hardware store supplied materials, confidence in the methods that were used is bolstered.

At the end of Experiment 1, an attempt was made to "fail" the Coil Section at the maximum offset position of the model. This model offset is much more than would occur in actual practice. It is noteworthy that although this was quite a severe condition, and the Coil Section was permanently extended, nothing came apart. Although this should not be construed as a design attribute, it indicates that the Concept does provide some forgiveness for conditions that may exceed design expectations.

Much was learned about the model apparatus and its limitations during the set-up for Experiment 1. Since this work was performed solely for purposes of simple assessment of a concept, no costly effort was made to overcome observed deficiencies.

Appendix IV

Brief Summary of Recent Deepwater Developments

Riser concepts and designs have evolved along with the various types of offshore field developments. Field development configurations are dependent on water depth, reservoir size and properties, fluids properties and the environmental conditions. A summary of Gulf of Mexico representative field development methods is provided in FIG. E-1 of the U.S. Provisional Patent Application filed on Apr. 26, 2002 under Ser. No. 60/375,619. All subsequent references to figures and tables in this Appendix will be with respect to the U.S. Provisional Patent Application filed on Apr. 26, 2002 under Ser. No. 60/375,619. Given the nature of well development drilling, completion, production and well work over operations, the field developments that use Conventional Platforms have established a long and proven track record for water depths approaching 1500 feet of water. These platforms are rigid structures that are designed not only to support topsides equipment, but they also fully resist the large environmental loads. The well risers, consisting of the surface conductor, drill casings, production casing and production tubing are supported by the surface conductor, which is anchored, usually by pile-driving it, into the seabed. Conductor guides, which are imbedded within the platform structure, are spaced to prevent the conductor from buckling due to its self and supported weights[4]. This arrangement provides the desirable hands-on access to the surface wellhead equipment. This "dry" well equipment access exists throughout the field life. In the relatively shallow water, export and import risers can be "stalked-on" to the platform with the assistance of divers. However, as water depths increase, the J-tube pull-in riser is generally preferred. This is because the need for diving support is eliminated. As water depths increase, commercial diving support is feasible to a little more than 1000 feet of water. However, saturation diving, which is necessary beyond 180 feet of water, is costly and there can be safety issues to consider as well. Even so, the stalk-on riser method can be used when necessary, with water depth limitations as noted.

As water depths continue to increase, the Compliant Tower Jacket (CTJ)[5] can be an alternative field development method. This name is used because it is a flexible structure. This flexibility reduces the environmental loads that would need to be accommodated if it were of the more rigid conventional platform design. Thus, for a given water depth, the CTJ contains less steel, resulting in cost advantages when compared to conventional platforms. Above the water line, the CTJ looks much like the conventional platform, providing the "dry" well equipment features, with support to this equipment still being provided by the surface conductors. As the water depth increases, the depth to which the surface conductor is anchored into the seabed increases. Due to soft bottom conditions that prevail to several hundred feet below the seabed in many parts of the Gulf of Mexico, proper placement of these conductors using pile-driving technology can be a challenge. J-Tube risers can be used for export and import risers for many cases, but stalk-on or steel catenary risers are also viable alternatives.

The Tension Leg Platform field development method originated in the early 1970's. This concept introduced the floating hull method as a way to keep the Host Facility cost from escalating due the large quantities of steel that are required by bottom-founded structures as the water depth increases. A bottom-founded structure requires that the amount of steel that is needed just to support its own weight will increase geometrically with water depth. The TLP, combined with highly tensioned mooring tendons, reduces the amount of heave (up-and-down) motions to a much smaller amount than would exist if the hull were spread-moored. This feature makes it feasible to attach the well system equipment to the TLP, retaining "dry" equipment features. However, even though the heave motions are small, the TLP will still move laterally due to its response to environmental loadings. Thus, the riser top-tensioning equipment is designed to provide a strokelength to accommodate the small up and down motions as well as the riser length change that occurs as the TLP moves laterally. This top tensioning assembly stroke length capability prevents the riser from being over-stressed as the TLP moves in response to the environment and load changes on the TLP itself. Also, the riser top tensioning assembly should maintain a relatively constant tension along with the stroke length changes. This is performed to prevent the large stress cycles that could otherwise limit fatigue life of the riser. The riser tensioning systems add complexity and weight to the Host Facility, but allow retaining the "dry" features. Several TLP's have been installed since the 1980's, and their design methodologies have matured accordingly[7].

The pace at which the need for field developments in deepwater has increased rapidly. In the early 1990's, it was thought that commercial viability of field developments would probably be in the range of 3000–4000 feet of water in the Gulf of Mexico. Since TLP technology was viable to these water depths, it was thought that the TLP, top-tensioned risers, and steel catenary risers could meet most, if not all, of these needs. Even so, there remained concerns about the high cost of these systems, primarily due to the way that tendon size and weights escalate beyond 3000 feet of water. New technology approaches to address these TLP needs were initiated. Some of the most notable include the use of new materials to reduce topsides weight and consideration for the use of new materials for tendons, production, and drilling risers[8,9]. In the interim, exploration drilling has continued to identify field development opportunities well beyond 4000 feet. Thus, while the TLP well and export and import riser needs can be met efficiently using top-tensioning methods to about 4000 feet, the TLP approach remains challenged for the deeper water applications.

During the mid-1980's, a new type of riser system was conceived to address some of the disadvantages that exist with the top-tensioned export and import risers. It was called the Steel Catenary Riser (SCR). This name is based on the shape that the riser takes as it bridges between its connection point on the Host Facility to an offset position that is located on the seabed. It offers technical and cost advantages for those top-tensioned riser applications that do not require vertical access. Since vertical access is needed for drilling and completion risers, the SCR approach is limited to the export and import riser applications. First commercial use of the SCR risers was for the Auger TLP export pipelines[6,10]. Following this success, SCR's continue to meet many deep-water field development needs.

Also, during the mid-1980's, a new type of hull system that can be used for the Host Facility was conceived[11]. It is referred to as a Deep Draft Caisson Vessel (DDCV). It is also called a "Spar", which refers to its up-right appearance when it is installed, but before the topsides have been installed. The DDCV has been used for some field developments that are in water depths for which the TLP or other methods are too costly. The riser systems for a DDCV can use buoyancy in the upper riser section, which is guided through the central section of the hull. This method not only meets the requirements for top tensioning of each well riser, but it reduces the load that the hull carries. The Spar drilling riser may be top-tensioned using an approach that is similar to the one that is used for the TLP. The Spar surface well equipment retains "dry" access to the wells. Export and import SCR's, which do not require the vertical access, are commonly attached to the hull. In some circumstances, even the well equipment may be provided with top-tensioning equipment rather than using buoyancy in the riser. The Spar hull, which may be either spread moored or taut moored, provides heave motions that are somewhat similar to those of the TLP, but the Spar can handle topsides weight increases more efficiently than a comparable TLP. Thus, the Spar mooring system cost does not increase geometrically as the water depth increases. The Spar riser stroke length is considerable for the extreme design events, but topsides can be configured to accommodate these clearance, or headroom, needs. It is thought that the DDCV/Spar approach may continue to be cost efficient as exploration success in ultra-deep water continues.

With continuing increase of the water depth and additional topsides payload capacity requirements, a Host Facility called a Semi-submersible-shaped Floating Production System (FPS)[12] can provide cost advantage over a DDCV. Although FPS's have been used many times for field developments in other areas, especially offshore Brazil, they have not yet seen frequent application in the Gulf of Mexico. The spread-moored FPS provides favorable motions for producing operations, but these motions are not compatible with the use of "dry" well equipment due to the riser stroke challenge. Thus, they are most often used with subsea equipment and "wet" wells as represented in this drawing. Mobile Offshore Drilling Units (MODU's) are used to drill and complete the subsea wells that are laterally offset from the FPS. Since the FPS is offset from the subsea wells, the SCR's can be routed directly to the Host Facility and connected to the hull. Another variation on the FPS is to locate the subsea wells directly under the FPS. In this configuration, the FPS can be equipped with a drilling rig that can meet these "wet" subsea well needs. Floating well drilling and completion methods are used for these wells. SCR's that are needed for export are connected directly to the hull. However, seabed manifold equipment is commonly used to commingle production so that a reduced number of SCR's can be used for the import riser duty. A flowline is run outward and away from the Host Facility. It is then routed through a 180-degree turn so that the SCR approach to the FPS is provided in a straight line.

Another type of floating system, referred to as a Floating Production Storage and Offloading (FPSO) system, has been used elsewhere, with application area environments ranging from quite benign to extremely harsh[13]. This particular configuration includes a new large diameter export riser concept[14] called a Helical-base Riser. It provides a means to meet the very long stroke requirements for a large diameter rigid riser (steel) that might be used with an FPSO system. The use of FPSO-based developments in the Gulf of Mexico has only recently been approved by the Minerals Management Service (MMS). Since the FPSO type system and its risers may be applied at some undefined time in the future, further discussion is premature.

Each of the previous field development methods are based on technology that is relatively mature, but ultimate field development costs remain high. A significant cost element remains the cost of meeting the riser system needs. Table E-1 of the U.S. Provisional Patent Application Ser. No. 60/375,619 filed on Apr. 26, 2002 provides a summary for the types of risers that have been discussed above.

Appendix V

BTR Performance

Overall BTR system relationships are shown in FIG. E-5, of the U.S. Provisional Patent Application filed on Apr. 26, 2002 under Ser. No. 60/375,619. All subsequent references to figures and tables in this Appendix will be with respect to the U.S. Provisional Patent Application filed on Apr. 26, 2002 under Ser. No. 60/375,619. Typical results for the riser top tensile stress that are provided in FIG. E-4B, indicate that the BTR system can provide efficient vertical riser solutions for deepwater applications. FIG. E-5 represents a summary of pertinent information that is individually developed as shown FIG. E-6 and FIG. E-7. The BTR system is directed to those deepwater riser duties that do not require vertical access. These duties are generally regarded as export and import risers.

The BTR concept could be used for some export and import riser applications with considerable benefit over present methods. The combinations of very deep water and the deep reservoirs can result in the need for handling very high pressure and temperature fluids. The BTR system provides a solution that is all metal. This is a very important advantage for the high pressure and temperature situations. Table E-2 (reproduced below) provides a summary list of advantages and disadvantages for the BTR concept.

TABLE 1

BTR Advantages & Disadvantages

| Advantages | Disadvantages |
|---|---|
| Low Cost<br>Minimum impact on Host Facility Design<br>Small Seabed Footprint<br>All Steel, Vertical Riser Design<br>Small Top Tensile Loads for Full Range of Host Facility Offsets<br>Coil Section can be Changed (if necessary) Throughout Field Life<br>"Forgiving" Design if Host Facility Motions are Different from those Predicted<br>Minimum number of Active Components to Maintain or Repair | New<br>Requires New Design Methodologies<br>New Challenges for Manufacturing, Transportation and Installation<br>Demonstration of Life-of-Field Materials behavior in Coil Section will need to be evaluated |

As can be observed from FIG. E-5 and FIG. 2 herein, the top tensioning assembly, including provision for accommodating basic riser length changes as the Host Facility moves, is placed in the lower part of the riser. By doing this, the top tension load is limited to that of the riser self weight, external environment loads on the riser, and the tension that is developed by the Coil Section 27 to provide structural integrity of the riser for these external loads. The really large differences between this approach and traditional top tensioning assemblies is that the BTR tensioning assembly does not need to carry the riser self weight and by virtue of the Coil Section 27 location, riser stroke length needs can be easily accommodated. This Coil Section 27 includes a combination of pipe coils and rod/gas pressurized cylinder assemblies.

As shown in FIG. E-6 and FIG. 10 herein, the Coil Section 27 includes a series of pipe coils. The purposes of these coils are primarily twofold: First, they provide product pressure containment and continuity from the main riser pipe to the riser base connection. Second, they provide the riser flexibility that allows the main riser body to move along with the Host Facility without incurring excessive riser top tensile stresses. The coil behavior is assumed to be similar to that of a spring coil that is made from a solid rod of a particular material [17].

These relationships are recognized for their intended purpose, which is to provide reasonable first approximations for the evaluation of this new riser concept To account for this difference between a solid rod and a tube, an equivalent tube diameter is estimated using the cross-section moment of inertia equivalency as the means for approximating a solid rod diameter. Determination of appropriate tube coil relationships that can be used with confidence for Coil Section 27 design purposes will be necessary as a first step forward to mature this concept. Regardless, application of these solid rod principles is straight forward, and the first approximations should provide reasonable results.

The coil design boundaries are determined by the combination of application duties and manufacturing limitations. It is desirable to make the coil diameter as small as possible for at least two reasons:

First, the coil stiffness modulus is an inverse exponential relationship to the coil diameter. The smallest possible diameter provides the largest stiffness modulus. And the larger the stiffness modulus, the closer the Coil Section system modulus is to that of the main riser itself. Also, the smaller the coil radius is, the smaller the resulting seabed footprint. As discussed previously, this is desirable to simplify subsea architecture. The smallest feasible diameter can ease manufacturing, transportation, and installation requirements, which are directly related to costs and risks.

Second, the coil diameter needs to keep the pipe strain within acceptable design practice limits[18, 9]. This requirement is best met by increasing the coil diameter. Since application duty will also require accommodating pigging operations, the Industry criteria for minimum pipe bend radius, which is the same as that required for maximum strain, has to be followed.

FIG. E-6, FIG. E-7 and FIG. 10 herein summarize what the assembled coils, including the upper and lower transition sections, can look like to meet these objectives. Although there are many ways that can be used to solve the underlying geometry, the method that is provided in these drawings is straightforward and suitable for first approximations. Based on these relationships, single coil solutions vs. coil pipe outside diameter for the minimum pipe bend criteria are provided in FIG. E-7, FIG. E-9, FIG. E-10, and FIG. 10 herein This information is representative of maximum conditions.

The relationships for the closed system cylinder and rod assembly that are provided in FIG. E-11 can be used to determine this assembly Stiffness Modulus. Summary results are provided in FIG. E-14.

The Coil Section 27 components, as described earlier, result in the configuration and relationships that are shown on FIG. E-15. Although numerous possible solutions exist, it is assumed for this concept assessment work that four cylinder and rod assemblies are used. Also, the equipment design is based on the use of a sea chest to pressure balance the equipment at its subsea operating depth. This result provides efficient use of gas pressure that can be readily accommodated at both surface and subsea conditions and controlled and clean fluid displacement from the underside of the piston elements.

Appendix VI

BTR Installation

A representative description of the BTR system installation activities will not be given. The objective is to provide information about one way in which the BTR System could be installed. The method that is described should result in little interference with other activities that may be taking place on the Host Facility. Other installation methods may be preferred for other specific installation equipment and site-specific situations. The activities that are described are based on the use of installation equipment that reduces the amount of Host Facility assistance as much as is practical under the circumstances.

Modern deepwater installation equipment comes with fully equipped facilities that are needed for this sort of work. Such facilities include high capability dynamic positioning and station keeping systems. Even so, deepwater riser installation activities, including those described below, are often weather and water column current sensitive. Thus, the riser installation activities are progressed as the environment is determined to be in accordance with the pre-determined limits for each activity.

Initial Conditions

As shown in FIG. I-1 of the U.S. Provisional Patent Application filed on Apr. 26, 2002 under Ser. No. 60/375, 619, the Host Facility is spread moored at its permanent location. All subsequent references to figures in this Appendix will be with respect to the U.S. Provisional Patent Application filed on Apr. 26, 2002 under Ser. No. 60/375, 619.

1. The seabed riser base connector is pre-installed,
2. The riser top connector is pre-installed on the Host Facility, and
3. The riser installation aids are installed.

The riser top connector placement is shown on an outboard pontoon, but it could also be placed on the in-board side of the pontoon. This connector placement is shown below the water line, but it could also be placed at other locations, including a suitable connection point on the Host Facility that may be above the water line.

Coil Section

FIG. I-2 represents how the BTR Coil Section is transported from a land fabrication site to the field location on a cargo barge.

1. The Coil Section 27 is transported in a transportation frame. This frame is used to secure the Coil Section during transportation. It also provides structural strength to the Coil Section as it is lifted from the horizontal position into the vertical position.
2. The cargo barge is brought alongside a construction vessel that is equipped with a lifting crane.
3. The crane lifts the Coil Section into the vertical position (see FIG. I-3) until it is free of the cargo barge.
4. An auxiliary crane (not shown for clarity) on the construction vessel is used to assist with removal of the transportation frame. All materials having no further need in the field are loaded onto the cargo barge, and it is returned to port.
5. An installation vessel that is equipped to install the Main Riser and the Coil Section is brought to a location that is near the construction vessel, which continues to suspend the Coil Section in its vertical position. This is shown in the upper part of FIG. I-3. In this case, a reel-type vessel is used to install the Main Riser. The Main Riser and Coil Section could also be installed using a vessel that is outfitted for J-Laying pipe. It is also possible to use the Host Facility drilling rig to assist the Main Riser installation, but as previously mentioned, this assumed case is based on conducting the riser installation work with minimum interference with any other activities that may be taking place on the Host Facility.
6. As shown in the lower part of FIG. I-3, keelhaul rigging lines are run from the Riser Installation vessel to the top of the Coil Section. These activities can be performed using hard-hat diving because the water depth is relatively shallow, but it is also possible to use a remotely operated vehicle (ROV) to make the necessary connections as well.
7. The mating connector attaches to the bottom of the Main Riser and the top of the Coil Section is attached to the end of the Main Riser, which is suspended below the installation vessel.
8. Once the rigging is in place, the construction vessel crane lowers the Coil Section 27, and the riser installation vessel begins picking up the weight of the Coil Section, resulting in the Coil Section being located beneath the Main Riser and its Mating Connector
9. The Main Riser is lowered to engage the Coil Section Upper Connector, and this connection is made using ROV assist techniques. As can be seen in the upper portion of FIG. I-4, the Coil Section 27, Main Riser, keelhaul rigging lines, and construction vessel lowering lines are attached near the top of the Coil Section upper connector. Riser loads are now carried by way of the Main Riser body.

10. The connector is tested to confirm integrity.

11. Then, each of the handling lines is disconnected from the Main Riser using ROV methods. This results in the arrangement that is shown in the lower part of FIG. I-4.

12. The riser and Coil Section 27 can be lowered towards the seabed and the Construction Vessel released.

13. As the Main Riser reaches a pre-determined water depth and riser length, it is "hung-off" on the installation vessel.

14. In this reel-type installation vessel example, the Main Riser pipe is continuous, so it is cut off just above the hang-off point.

15. The Riser Top Connection Assembly is then attached to the Main Rise, pipe. This length of the Main Riser pipe and the Coil Section 27 , including consideration for pipe stretch due to self-weight and contraction of the pipe due to the cold water column, is shorter than the connection length between the riser base and the Host Facility riser top connection point.

Thus, after the Coil Section 27 is locked onto the seabed riser base as described further below, it will require an over pull at the top of the riser that is in excess of the weight of the Main Riser and Coil Section as it is landed at the Main Riser to the Host Facility connection point. This over pull, which is performed once the Coil Section 27 is readied for extension provides the Main Riser pre-tensioning that is required for the Main Riser structural stability when the Host Facility is located in its neutral, or no-offset position. Once the BTR is connected to both the Riser Base and the Host Facility, the Coil Section 27 extension and retraction accommodates Host Facility motions at its neutral position. At the same time, it maintains the riser top tension at the appropriate level as these motions take place. Although a separate handling line could be used for remaining Installation vessel activities, it is efficient to use the excess riser pipe that is still on the installation vessel.

As described above, the Main Riser is cut off above the Main Riser hang-off point. Thus, a riser handing assembly, which is robust, flexible, and capable of handling the weight of the riser, is attached to the end of the pipe that is still on the installation vessel. The flexibility is necessary to ensure that the Main Riser pipe is not over stressed or otherwise damaged during any of these handling operations.

16. This riser handling assembly is connected to the Riser Top Connection Assembly, 17. The installation vessel pipe tensioning equipment and excess riser pipe is used to lower the top of the Main Riser as necessary. If required for any reason, this equipment can also be used to raise the Main Riser. As mentioned previously, there are other methods for doing these activities. The preferred method is determined based on vessel specific information and installation engineering design.

18. Continuing with this example, the riser is in its suspended position and the Main Riser Installation vessel is maneuvered close to the Host Facility as shown in FIG. I-5.

19. The riser handling equipment and riser installation line that is located on the Host Facility is hauled over to the riser top and attached to the riser top connection assembly. Since this is usually a very heavy chain, appropriate rigging and handling equipment is used to assist making this connection. The connection activities may be aided by the use of hard-hat diving and ROV equipment.

20. This connected equipment is then used to take up the riser weight using a sequence of coordinated steps. These steps include:

moving the installation vessel toward the Host Facility; and as this is being performed, reducing the riser weight that is carried by the installation vessel and increasing the riser weight that is carried by the Host Facility riser installation line is increased.

The steps are complete when the Host Facility Riser Installation Line carries all of the riser weight as represented on the left side of FIG. I-6.

21. The Main Riser installation vessel Line and any related installation aids are disconnected from the Main Riser.

22. The Riser Installation vessel can then be released.

23. The Host Facility is positioned on its mooring so that the Main Riser and Coil Section 27 are located above and directly over the Riser Base Connector.

24. The Coil Section 27, which contains the upper portion of the Riser Base Connector, and the Main Riser are lowered onto the riser base connector, locked, and tested. These guideline-less connection methods are commonly used to install well and subsea equipment in deepwater. Since these connection activities occur in deepwater, ROV and related tooling methods are used exclusively to assist these Riser Base connection activities. An ROV is then used to perform additional duties after the BTR System is connected to the Riser Base. These may include:

disabling Coil Section locking mechanisms, removing various installation aids, and confirming readiness of the Coil Section Tensioning Units for the riser pre-tensioning activity.

25. For example, it may be determined that more or less Tensioning Unit cylinder gas pressure may be required to meet the actual Main Riser weight in water top tensioning objectives. The reason for this is that the actual riser weight in water may not be exactly as estimated. Any differences are usually due to the combination of engineering assumptions, manufacturing tolerances, and other minor deviations that may be unique to the installation site.

26. Once final adjustments are finished, the conditions that are represented on the left side of FIG. I-6 exist.

27. The Host Facility Riser Installation Line is used to pre-tension the Main Riser and the Coil Section 27. Lifting the Riser Top Connection to the appropriate level does this.

28. The Riser Top Connection is then landed into the docking receptacle as represented on the right side of FIG. I-6.

29. Auxiliary handling lines from the Host Facility may be used to assist landing the Riser Top Connection Assembly in the Host Facility docking receptacle.

30. Once the Main Riser is docked in the receptacle and the Riser handling equipment is removed, the BTR installation activities are essentially complete. Any remaining Host Facility piping bridging between the top of the riser and Host Facility piping is installed and tested as appropriate. Once all risers that are to be installed are completed, related Host Facility Installation Aids would typically be removed.

LIST OF REFERENCES

All of Which are Hereby Incorporated by Reference

1—Moran, K.:"Deepwater Technology in the International Ocean Drilling Program", *Offshore Technology Conference* (1–4 May, 2000), OTC 12179

2—Moyer, M.C., Barry, M.D., Tears, N.C.: "Hoover-Diana Deepwater Drilling and Completions", *Offshore Technology Conference* (Apr. 30–May 3, 2001), OTC 13081

3—Bates, John B., Kan, Wan C., Allegra, Allen P., Yu, Allen: "Dry Tree and Drilling Riser System for Hoover DDCV", *Offshore Technology Conference* (Apr. 30–May 3, 2001), OTC 13084

4—Stahl, B., Baur, M. P.: "Design Methodology For Offshore Platform Conductors", *Offshore Technology Conference* (May 5–8, 1980), OTC 3902

5—Simon, J. V., Edel, James C., Melancon, Charles: "An Overview of the Baldplate Project";, *Offshore Technology Conference* (May 3–6, 1999), OTC 10914

6—Enze, C. R., Brasted, L. K., Arnold, Pete, Smith, J. S., Luyties, W. H.: "Auger TLP Design, Fabrication, and Installation Overview", *Offshore Technology Conference* (May 2–5, 1994), OTC 7615

7—Recommended Practice for Planning, Designing, and Constructing Tension Leg Platforms, *API Recommenced Practicee* 2T, Second Edition, August 1997

8—Hanna, Shaddy Y., Salama, Mamdough M.: "New Tendon and Riser Technologies Improve TLP Competitiveness in Ultra-Deepwater", *Offshore Technology Conference* (Apr. 30–May 3, 2001), OTC 12963

9—Botker, Stig, Storhaugh,Turid, Salama, Mamdough M.: "Composite Tethers and Risers in Deepwater Field Development: Step Change Technology", *Offshore Technology Conference* (Apr. 30–May 3, 2001, OTC 13183

10—Hays, P. R.: "Steel Catenary Risers for Semisubmersible Based Floating Production Systems", *Offshore Technology Conference* (May 6–9, 1996), OTC 8245

11—Halkyard, John, Horton, Edward H.: "Spar Platforms for Deep Water Oil and Gas Fields", *MTS* Journal, Vol. 30, No. 3, 3–12

12—Blincow, R. M., Whittenburg, L. A., Pickard, R. D.: "GB 388—An Independent's Approach to Deepwater Development", *Offshore Technology Conference* (May 1–4, 1995), OTC 7842

13—Leghorn, J., Brookes, D. A., Shearman, M. G.: "The Foinaven and Schiellion Developments", Offshore Technology Conference (May 6–9, 1996), OTC 8033

14—McShane, Brian M., Bruton, David A. S., Palmer, Andrew C.: "Rigid risers for floating production systems in deepwater field developments", Pipes & Pipelines International, January–February 2000

15—Design of Risers for Floating Production Systems (FPS's) and Tension Leg Platforms (TLP's), *API Recommended Practice* 2RD First Edition, June 1998

16—Serta, Otavio B., Longo, Carlos E. V., Roveri, Francisco E.: "Riser Systems for Deep and Ultra-Deepwaters", *Offshore Technology Conference* (Apr. 30–May 3, 2001), OTC 13185

17—Baumeister, Theodore, Avallone, Eugene A., Baumeister III, Theodore: "Marks'Handbook for Mechanical Engineers", Eighth Edition, 1978, pages 8–76/8–77

18—Design, Construction, Operation, and Maintenance of Offshore Hydrocarbon Pipelines (Limit State Design), *API Recommended Practice* 1111, Third Edition, July 1999

19—Kopp, F., Peek, R.: "Determination of Wall Thickness and Allowable Bending Strain of Deepwater Pipelines and Flowlines", *Offshore Technology Conference* (Apr. 30–May 3, 2001), OTC 13013

20—Byle, Steven M.: "Tension control device for tensile elements", U.S. Pat. No. 6,190,091, Feb. 20, 2001

21—Davies, Richard; Finn, Lyle D., Pokladnik, Roger: "Riser tensioning device", U.S. Pat. No. 5,758,990, Jun. 2, 1998

I claim:

1. A marine riser assembly, comprising:

(a) a relatively rigid, vertical, relatively long upper section adapted to be carried by a facility floating on the surface of a body of water, having an upper end adapted to be in flow communication with said facility, and having a lower end;

(b) a relatively rigid, vertical, relatively short lower section adapted to be secured to the seafloor, having a lower end to be in flow communication with a fluid system carried by the seafloor, and having an upper end;

(c) extensible means for flexibly connecting said upper section to said lower section, said extensible means having one end connected to said upper end of said lower riser section and in flow communication therewith, and having an opposite end connected to said lower end of said upper riser section and in flow communication therewith; and (d) tensioning means mechanically connecting said one end of said extensible means to said opposite end of said extensible means, for biasing said upper riser section towards said lower riser section and thereby resisting relative movement between said floating facility and said lower end of said lower riser section, wherein said tensioning means comprises:

(i) a cylinder, having one end for being open to sea pressure, having an opposite end sealed from sea pressure, and connected to one of said upper section and said lower section;

(ii) a piston within said cylinder slidingly and sealingly disposed for movement within said cylinder; and (iii) a piston rod sealingly and slidingly disposed for movement through said opposite end of said cylinder, having one end connected to said piston, and having an opposite end connected to the other of said upper section and said lower section.

2. The marine riser of claim 1, wherein said extensible means comprises a section of riser pipe that wrapped about a common axis.

3. The marine riser of claim 1, wherein said piston rod, piston and said opposite end of said cylinder define a volume filled with an inert gas.

4. The marine riser of claim 3, wherein said volume is pressurized in excess of the ambient sea pressure.

5. The marine riser of claim 3, further including a container in fluid communication with said volume defined by said piston, piston rod and cylinder.

6. The marine riser of claim 3, further including means for introducing pressurized gas into said volume.

7. The marine riser of claim 1, further including a gimbaled connection between said opposite end of said piston rod and said other of said upper section and said lower section.

8. The marine riser of claim 1, wherein said extensible means comprises a length of marine riser wound helically about a vertical axis to form a plurality of coils in the form of a helix.

9. The marine riser of claim 1, wherein said opposite end of said cylinder is connected to said lower section; and said opposite end of said piston rod is connected to said upper section.

10. The marine riser of claim 5, wherein said container is carried by said cylinder.

11. The marine riser of claim 8, wherein said axis of said helix and said length of marine riser define the interior of said helix, and wherein said cylinder is located within said interior of said helix.

12. The marine riser of claim 1, further including:

(a) a second cylinder, having one end open to sea pressure, having an opposite end sealed from sea pressure, and connected to said one of said upper section and said lower section;

(b) a second piston within said second cylinder slidingly and sealingly disposed for movement within said second cylinder; and (c) a second piston rod sealingly and slidingly moving through said opposite end of said second cylinder having one end connected to said second piston and having an opposite end connected to said other of said upper section and said lower section.

13. The marine riser of claim 12, further including an upper connector that is mechanically joined to said lower end of said upper section; and wherein said opposite ends of said two piston rods are mechanically connected to said upper connector.

14. The marine riser of claim 12, further including a lower connector that is mechanically joined to said upper end of said lower section; and wherein said cylinders are mechanically connected to said lower connector.

15. The marine riser of claim 6 , wherein said gas is at a sufficiently high pressure relative to the pressure of the surrounding water that said piston is biased toward said other end of said cylinder.

16. The marine riser of claim 5, wherein said container of gas is located on the exterior of said cylinder.

17. The marine riser of claim 1, wherein said one end of said cylinder is in flow communication with the body of water by means of a sea chest.

18. The marine riser of claim 1, further including a base that is adapted to be carried by said seafloor and that is in flow communication with said fluid system; and wherein said lower end of said lower section is in flow communication with said base.

19. The marine riser of claim 1, further including locking means for locking said piston rod to said cylinder.

20. The marine riser of claim 19, wherein said locking means comprises: a first pawl that is carried by one of said cylinder and said piston rod, and that has a distal end; and a second pawl that is carried by the other of said cylinder and said piston rod, and that has a distal end adapted to move between a locked position where said distal end of said second pawl is captured by said distal end of said first pawl, and an unlocked position where said distal end of said second pawl is released from said distal end of said first pawl.

21. The marine riser of claim 20, said second pawl is moved between said locked position and said unlocked position by means of a lead screw.

22. The marine riser of claim 2, wherein said axis is generally vertical and said section of riser pipe is wrapped in the form of a helix.

* * * * *